US011761259B2

(12) United States Patent
Aaron et al.

(10) Patent No.: US 11,761,259 B2
(45) Date of Patent: Sep. 19, 2023

(54) INTERFACE GASKET FOR BUILDING ENVELOPE

(71) Applicant: UT-BATTELLE, LLC, Oak Ridge, TN (US)

(72) Inventors: Adam M. Aaron, Knoxville, TN (US); Mahabir S. Bhandari, Knoxville, TN (US); Venugopal K. Varma, Knoxville, TN (US); Charles D. Ottinger, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 247 days.

(21) Appl. No.: 17/393,106

(22) Filed: Aug. 3, 2021

(65) Prior Publication Data

US 2022/0042366 A1 Feb. 10, 2022

Related U.S. Application Data

(60) Provisional application No. 63/060,951, filed on Aug. 4, 2020.

(51) Int. Cl.
*E06B 1/60* (2006.01)
*E06B 7/23* (2006.01)

(52) U.S. Cl.
CPC ..... *E06B 1/6069* (2013.01); *E06B 7/2314* (2013.01)

(58) Field of Classification Search
CPC ..... E04B 1/02; E04B 1/6015; E04B 1/6069; E04B 1/62; E04B 1/68; E04B 7/2314
See application file for complete search history.

(56) References Cited

U.S. PATENT DOCUMENTS 1,483,851 A * 2/1924 Perry ..... E04B 1/02 52/204.55
3,583,114 A * 6/1971 Belfor ..... E06B 1/20 49/505
4,250,673 A * 2/1981 Hubbard ..... E06B 1/6015 52/745.16
6,526,709 B1 * 3/2003 Jacobsen ..... E06B 1/02 52/211
7,490,441 B2 * 2/2009 Burton ..... E06B 7/14 52/302.1
7,641,274 B2 * 1/2010 Boehm ..... B60J 10/18 296/211
7,669,382 B2 * 3/2010 Burton ..... E06B 1/6069 52/204.55

(Continued)

*Primary Examiner* — James M Ference
(74) *Attorney, Agent, or Firm* — FOX ROTHSCHILD LLP

(57) ABSTRACT

A gasket assembly for attaching a window to a panel opening includes an inner frame, an outer frame, and an elastic material connecting the inner frame to the outer frame. The elastic material extends contiguously and circumferentially to couple the outer frame to the inner frame. The outer frame and inner frame can include gap flanges and the elastic material can include opposing lateral side portions. The gap flanges are embedded in the lateral side portions of the elastic material. The outer frame includes connecting structure for coupling of the outer frame to the panel opening. The inner frame includes a connecting structure for coupling of the gasket assembly to the window. The gasket assembly is configured to support the window in the panel opening and form a seal between the panel opening and the window. A method of making a gasket assembly is also disclosed.

15 Claims, 25 Drawing Sheets

(56) References Cited

U.S. PATENT DOCUMENTS

| | | | | |
|---|---|---|---|---|
| 8,109,052 | B2 * | 2/2012 | Rosende | E06B 1/6015 52/204.55 |
| 9,021,753 | B2 * | 5/2015 | Michaud | E06B 1/68 29/897.3 |
| 2004/0111973 | A1 * | 6/2004 | Moisy | B60J 10/32 49/490.1 |
| 2006/0232093 | A1 * | 10/2006 | Boehm | B32B 17/10761 296/96.21 |
| 2008/0271413 | A1 * | 11/2008 | Michaud | E06B 1/62 52/786.13 |
| 2010/0251643 | A1 * | 10/2010 | Rosende | E06B 1/62 52/204.2 |
| 2013/0008106 | A1 * | 1/2013 | Michaud | E06B 1/68 52/213 |
| 2022/0042366 | A1 * | 2/2022 | Aaron | E06B 1/6069 |

* cited by examiner

INTERFACE GASKET FOR BUILDING ENVELOPE

CROSS-REFERENCE TO RELATED APPLICATIONS

This application claims priority to U.S. 63/060,951 filed on Aug. 4, 2020, entitled "Interface Gasket for Building Envelope Penetrations" the entire disclosure of which incorporated herein by reference.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in this invention.

FIELD OF THE INVENTION

The present invention relates building constructions, and more particularly to the installation of windows and other objects into building openings.

BACKGROUND OF THE INVENTION

The integration of windows into walls in commercial and residential buildings has conventionally been an inefficient, under-defined process where large margins were left by the wall/panel manufacturer to allow the window manufacturer flexibility in installation. As a result, this process has been inefficient from both a time and economic perspective. Additionally, conventional integration technologies often create thermal bridges, decreasing the energy efficiency of the buildings. There is a need for panel manufacturers and window manufacturers to openly communicate, gather information, and propose other techniques that improve energy, time, and economic efficiency of the window installation process.

SUMMARY OF THE INVENTION

A gasket assembly for attaching a window having a perimeter to a panel opening having a perimeter includes an inner frame comprising a first rigid material. The inner frame can be shaped to match the perimeter of the window. An outer frame includes a second rigid material, wherein the outer frame is spaced apart by a gap from the inner frame. The outer frame can be shaped to match the perimeter of the panel opening. An elastic material is joined to a portion of the outer frame and to a portion of the inner frame, and extends contiguously and circumferentially over the gap to couple the outer frame to the inner frame. The outer frame and the inner frame are connected only by the elastic material.

The outer frame and inner frame can include gap flanges and the elastic material includes opposing lateral side portions. The gap flanges are embedded in the lateral side portions of the elastic material. The outer frame includes connecting structure for coupling of the outer frame to the panel opening. The inner frame includes a connecting structure for coupling of the gasket assembly to the window. The gasket assembly is configured to support the window in the panel opening and form a seal between the panel opening and the window.

The elastic material can be hydrophobic without voids or surface defects on a sealing surface thereof. The elastic material can be at least one selected from urethanes (polyurethane, TPU), rubbers, and nylon. The elastic material can have a Durometer Shore Hardness from 20 A to 90 A.

The elastic material can have a thickness of from 0.3 cm. to 1.25 cm. The elastic material can extend laterally outward beyond the gap flanges of the outer frame and the inner frame by from 0.1 cm. to 0.6 cm. The gap flanges and the gap have a width, and the width of each gap flange can be from 1.0 cm. to 2.0 cm. and the width of each gap can be from 0.5 to 4 cm.

The inner frame can be Z-shaped in cross-section. The inner frame can include a gap flange portion, a coupling portion, and an abutment portion. The gap flange portion can include a laterally inward extending flange embedded in a lateral side portion of the elastic material. The abutment flange can include a laterally outward extending flange. The connecting structure of the inner frame can include a T-fitting for engaging a window frame of the window.

The outer frame can be L-shaped in cross section. The outer frame can include a gap flange portion and a coupling portion. A surface of the elastic material can be planar, and the coupling portion can be planar and angled laterally outward. The coupling portion can be angled laterally outward with respect to the surface of the elastic material at an angle between 0.5 and 5 degrees from of a normal to the plane of the elastic material.

The window has a weight, the gasket assembly has a width, and the elastic material has a thickness and an elastic modulus. The elastic modulus and thickness of the elastic material support the weight of the window such that the gasket assembly width varies by no more than 10% elongation of the width of the elastic material when installed.

A method of making a gasket assembly for installing an object having a perimeter in a wall panel opening, can include the step of providing a mold defining a gap configured to match the perimeter of a portion of the object to be supported in the wall panel opening. The mold has a bottom, an inner circumferential side and an outer circumferential side. Inner frame supports are attached to the inner circumferential side. Outer frame supports are attached to the outer circumferential side. An inner frame is attached to the inner frame supports. The inner frame includes a gap flange extending laterally into the gap and spaced from the mold bottom. An outer frame is attached to the outer frame supports. The outer frame includes a gap flange extending laterally into the gap and spaced from the mold bottom. An elastic material is poured into the mold to a level above the gap flange of the inner flange and the gap flange of the outer frame. The elastic material embeds the gap flange of the inner support and the gap flange of the outer support. The elastic material is cured. A gasket assembly comprising the inner frame, the outer frame, and the elastic material is removed from the mold.

The object can be a window, a Clerestory window, a fixed door, a wall-mounted air conditioner, a vent, a duct, an exhaust fan, or another object. The method can further include the step of attaching a window to the inner frame of the gasket assembly to create a window and gasket assembly. The method can also include the step of attaching the window and gasket assembly to a wall panel opening.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
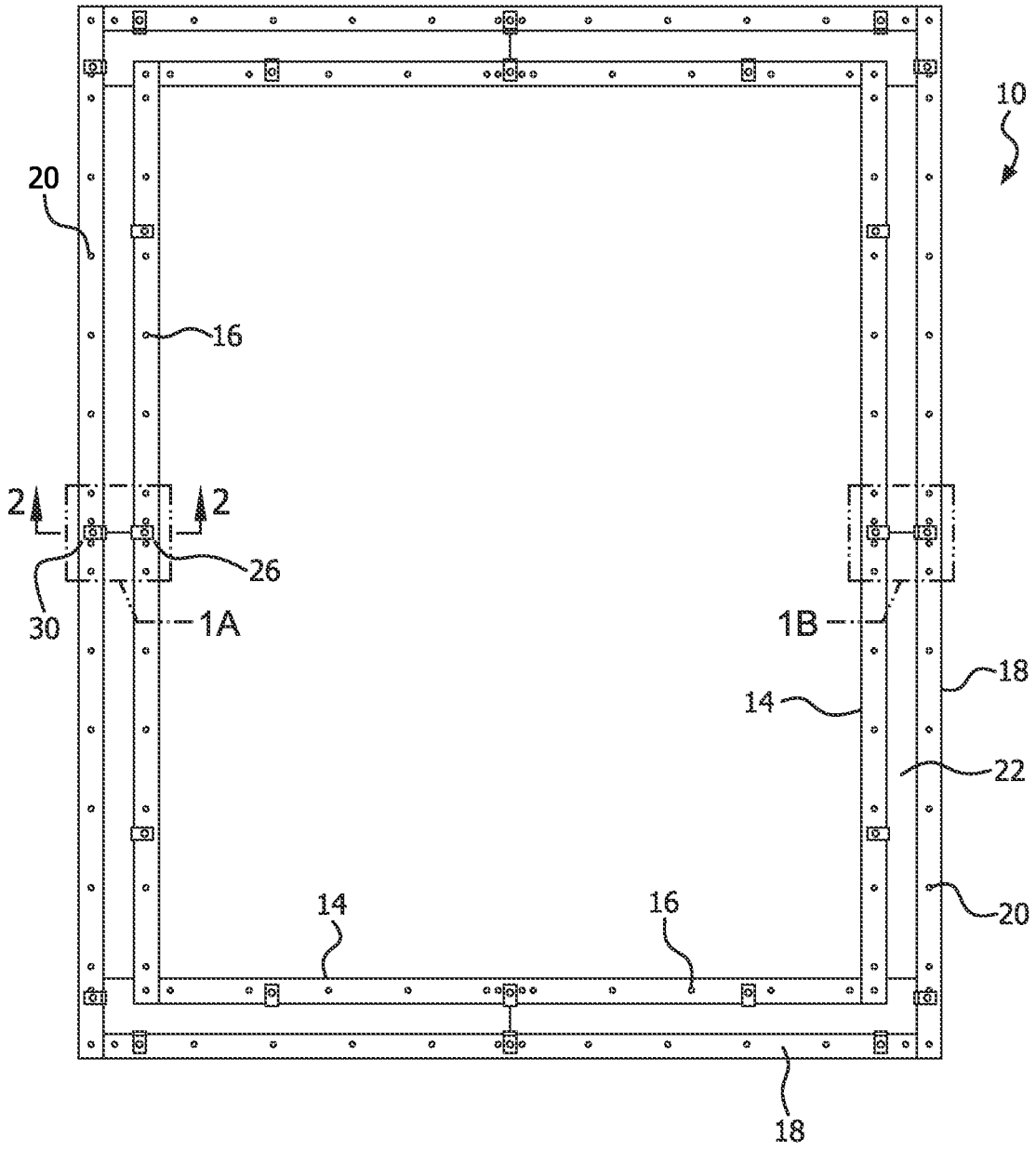
FIG. 1 is a plan view of a mold assembly according to the invention.
Figure 1A:
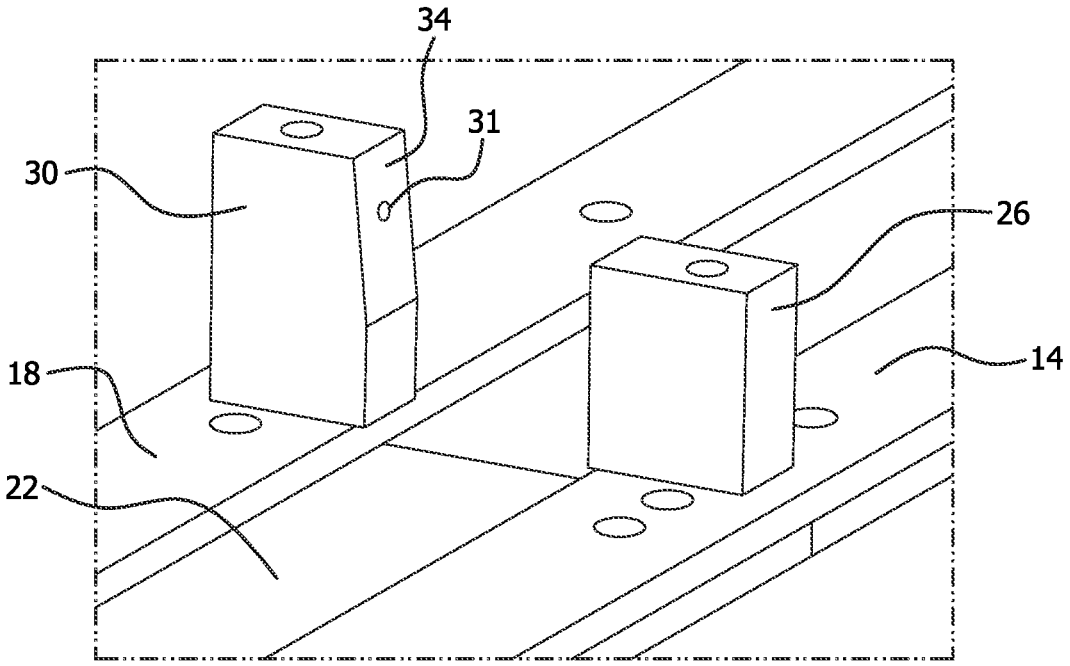
FIG. 1A is an enlarged view of area 1A in FIG. 1.
Figure 1B:
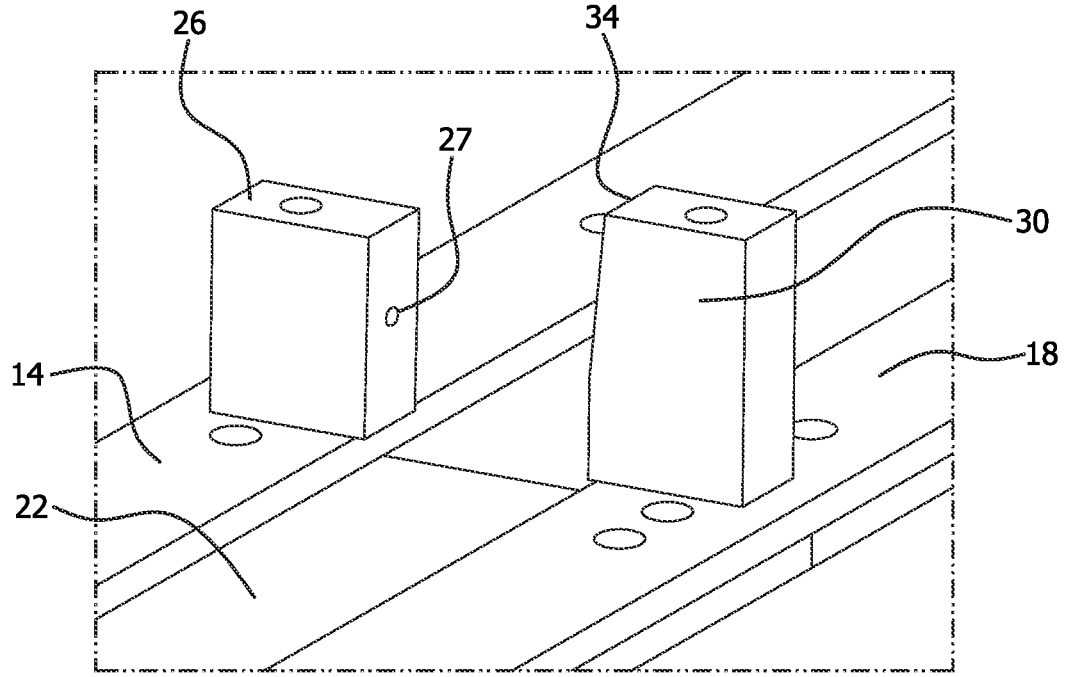
FIG. 1B is an enlarged view of area 1B in FIG. 1.

A gasket assembly for attaching a window having a perimeter to a panel opening having a perimeter includes an inner frame, an outer frame, and an elastic material connecting the inner frame to the outer frame. The inner frame includes a first rigid material, and is shaped to match the perimeter of the window. The outer frame includes a second rigid material, and is spaced apart by a gap from the inner frame. The outer frame can be shaped to match the perimeter of the panel opening. The elastic material is joined to a portion of the outer frame and to a portion of the inner frame, and extends contiguously and circumferentially over the gap to couple the outer frame to the inner frame. The outer frame and the inner frame can be connected only by the elastic material.

The outer frame and inner frame can include gap flanges and the elastic material can include opposing lateral side portions. The gap flanges are embedded in the lateral side portions of the elastic material. The outer frame includes connecting structure for coupling of the outer frame to the panel opening. The inner frame includes a connecting structure for coupling of the gasket assembly to the window. The gasket assembly is configured to support the window in the panel opening and form a seal between the panel opening and the window.

The elastic material is selected and dimensioned to support the weight of the object that is to be installed in the panel opening, such as a window, to be water-tight, and to be thermally insulating. The elastic material is hydrophobic without voids or surface defects on a sealing surface thereof. The elastic material can also be selected to be tough, provide good resistance from ultraviolet radiation, and be suitable for external use. The elastic material can be at least one selected from urethanes (polyurethane, TPU), rubbers, and nylon.

The invention can be used to install windows into window openings. The invention can also be used to install other objects. Such objects include, but are not limited to, a Clerestory window, a fixed door, a wall-mounted air conditioner, a vent, a duct, or an exhaust fan.

The window or other installed object can have a weight, the gasket assembly has a width, and the elastic material can have a thickness and an elastic modulus. The elastic modulus and thickness of the elastic material can support the weight of the window or other object such that the gasket assembly width varies by no more than 10% elongation of the overall width of the elastic material when installed. The gasket assembly width can vary by 0, 1, 2, 3, 4, 5, 6, 7, 8, 9 or 10% of the overall elastic material width, or can vary within a range of any high value and low value selected from these values.

The elastic material can have a Durometer Shore Hardness from 20 A to 90 A. The elastic material can have a Durometer Shore Hardness of 20 A, 30 A, 40 A, 50 A, 60 A, 70 A, 80 A, 90 A, and can have a Durometer Shore Hardness that is in a range of any high value and low value selected from these values.

The thickness of the elastic material can vary depending on the application. For example, where greater weight must be supported or additional insulation is required, a thicker elastic material can be used. The elastic material can have a thickness of from 0.3 cm to 1.25 cm. The elastic material can have a thickness of 0.3, 0.35, 0.4, 0.45, 0.5, 0.55, 0.6, 0.65, 0.7, 0.75, 0.8, 0.85, 0.9, 0.95, 1.0, 1.05, 1.1, 1.15, 1.2, or 1.25 cm, and can be within a range of any high value and low value selected from these values.

The elastic material extends laterally beyond the gap flanges and the outer frame and the inner frame to provide a form and elastic seal against the window or wall panel when the outer frame and inner frame are tightened into position. The width of this portion can vary. The elastic material can extend laterally outward beyond the gap flanges of the outer frame and the inner frame by from 0.1 cm. to 0.6 cm. The elastic material can extend laterally outward beyond the gap flanges of the outer frame and the inner frame by 0.1, 0.15, 0.2, 0.25, 0.3, 0.35, 0.4, 0.45, 0.5, 0.55, or 0.6 cm, and can be within a range of any high value and low value selected from these values.

The width of the gap flanges and the gap between the coupling portions of the outer frame and the inner frame can vary. The gap flanges and the gap have a width, and the width of each gap flange is from 1.0 cm. to 2.0 cm. The width of the gap flanges can be 1.0, 1.25, 1.5, 1.75, or 2.0 cm., and can be within a range of any high value and low values selected from these values. The total gap between the outer frame and the inner frame can be from 0.5 to 4 cm. The total gap between the outer frame and the inner frame can be 0.5, 1.0, 1.5, 2.0, 2.5, 3.0, 3.5, or 4.0 cm., and can be within a range of any high value and low value selected from these values.

The inner frame can be dimensioned and shaped to engage the perimeter of the object that will be installed in the opening, in the case of a window the window frame. The inner frame can be Z-shaped in cross-section. The inner frame can include a gap flange portion, a coupling portion, and an abutment portion. The gap flange portion can include a laterally inward extending flange embedded in a lateral side portion of the elastic material, and the abutment flange comprises a laterally outward extending flange. The connecting structure of the inner frame can include a T-fitting for engaging a window frame of the window.

The outer frame can be shaped to engage the portion of the wall panel or other structure surrounding the opening to which the object will be installed. The outer frame can be L-shaped in cross section. The outer frame can include a gap flange portion and a coupling portion, a surface of the elastic material is planar, and the coupling portion is planar and angled laterally outward. The angle between the coupling portion and the surface of the elastic material can be 0.5, 1, 1.5, 2, 2.5, 3, 3.5, 4, 4.5 or 5 degrees, and can be within a range of any high value and low value selected from these values.

The coupling portion of the outer frame can be angled laterally outward with respect to the surface of the elastic material at an angle between 0.5 and 5 degrees from of a normal to the plane of the elastic material. The coupling portion of the outer frame can be angled laterally outward with respect to the surface of the elastic material at an angle between 0.5, 1, 1.5, 2, 2.5, 3, 3.5, 4, 4.5 or 5 degrees from of a normal to the plane of the elastic material, or within a range of any high value and low value selected from these values.

The outer frame and inner frame can be made of a rigid material that is suitable for construction. Such materials include but are not limited to stainless steels, galvanized steels, aluminum, and polymeric materials.

The invention can be used to install an object in many different construction systems. The terms wall panel and opening are used in the broad sense to include many different wall and roof designs and wall and roof design materials and constructions. Similarly, the term opening refers to any opening in such walls or roofs into which the object must be mounted.

A method of making a gasket assembly for installing an object having a perimeter in a wall panel opening, can include the steps of providing a mold defining a gap configured to match the perimeter of a portion of the object to be supported in the wall panel opening. The mold has a bottom, an inner circumferential side and an outer circumferential side. Inner frame supports are attached to the inner circumferential side. Outer frame supports are attached to the outer circumferential side. An inner frame is attached to the inner frame supports. The inner frame includes a gap flange extending laterally into the gap and spaced from the mold bottom. An outer frame is attached to the outer frame supports. The outer frame includes a gap flange extending laterally into the gap and spaced from the mold bottom.

An elastic material is poured into the mold to a level above the gap flange of the inner flange and the gap flange of the outer frame. The elastic material embeds the gap flange of the inner support and the gap flange of the outer support. The elastic material is cured. The gasket assembly comprising the inner frame, the outer frame, and the elastic material is removed from the mold.

There is shown in FIGS. 1-6 a system and method for making a gasket assembly according to the invention. The system comprises a mold assembly 10 which includes an inner circumferential side 14, an outer circumferential side 18, and bottom 22. The inner circumferential side 14 has attachment apertures 16 and the outer circumferential side 18 has attachment apertures 20. Inner frame supports 26 are attached to the Inner circumferential side 14 at the attachment apertures 16 through cooperating threaded structures such as bolts. Outer frame supports 30 are attached to the outer circumferential side 18 at the attachment apertures 20 through cooperating threaded structures such as bolts.

Figure 2:
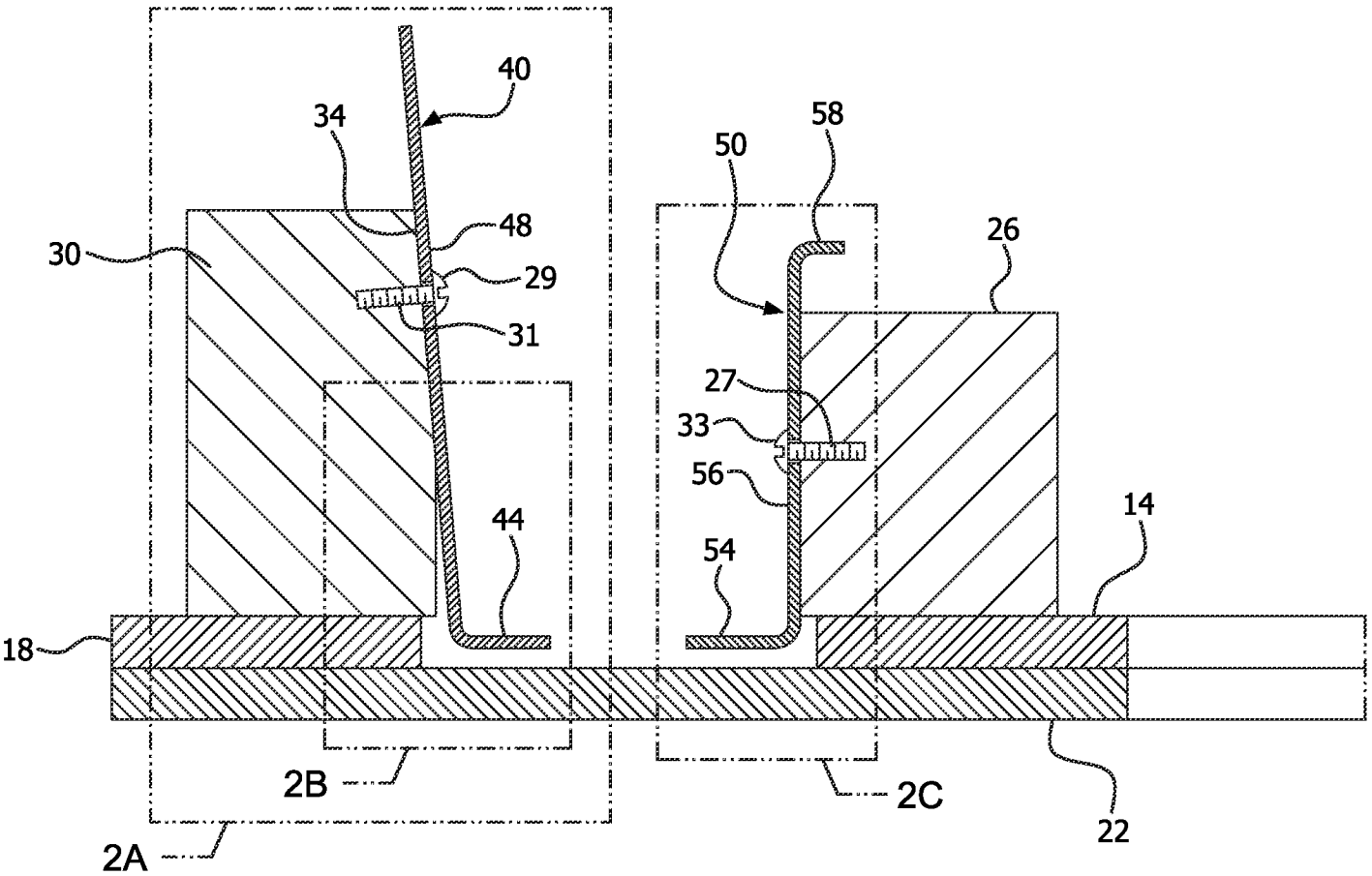
FIG. 2 is a cross section taken along line 2-2 in FIG. 1, with an inner frame and an outer frame installed in the mold assembly.
Figure 2A:
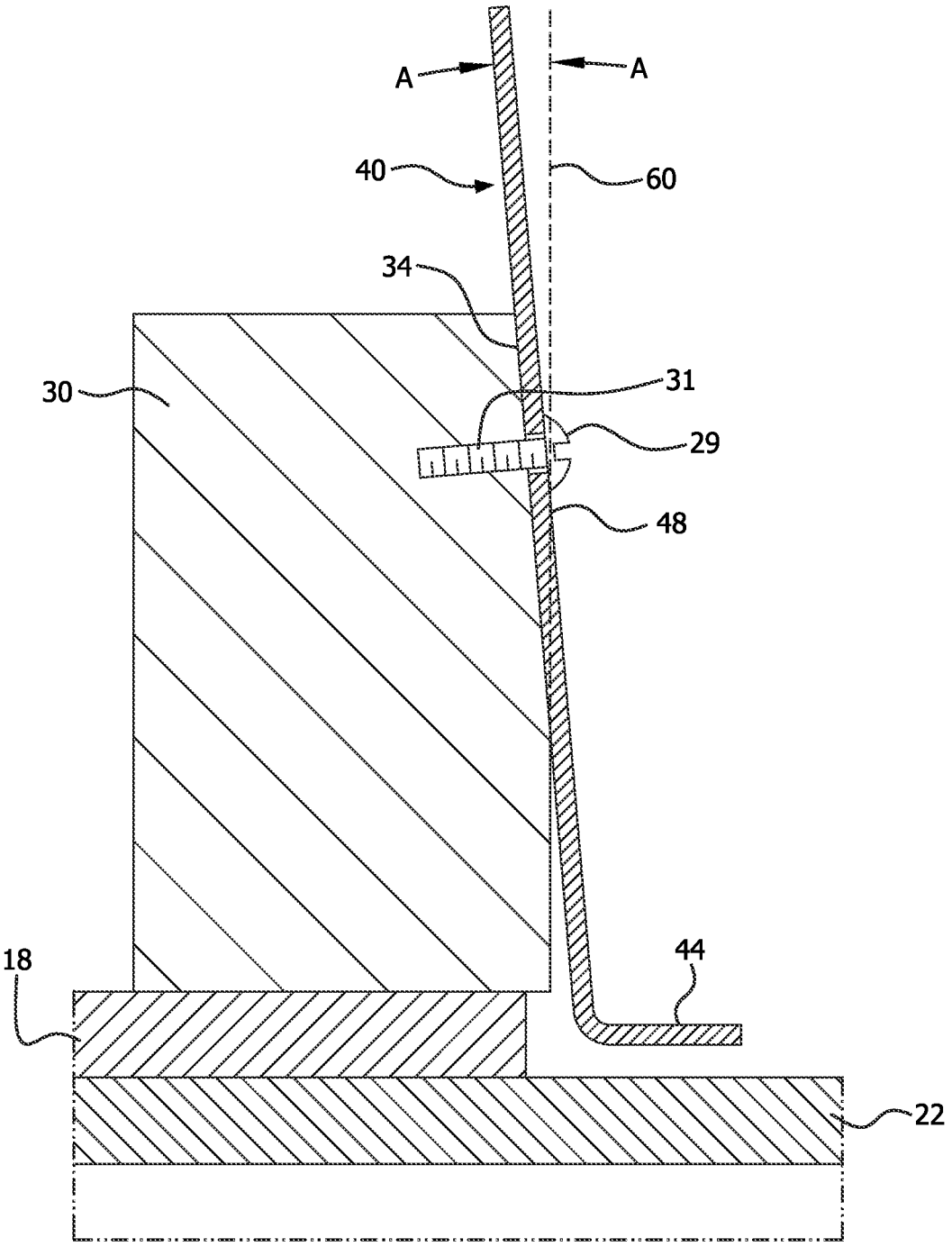
FIG. 2A is an expanded view of area 2A in FIG. 2.

An outer frame 40 can be attached to the outer frame supports 30, as by a bolt 29 in threaded opening 31. The outer frame 40 can be L-shaped and includes an outer frame gap flange 44 and a coupling portion 48. The outer frame 40 can have connecting apertures 46. An inclined surface 34 can be provided on the outer frame supports 30 to tilt the outer frame 40 during the fabrication process, as shown by the angle A-A firm the vertical axis 60 (FIG. 2A). An inner frame 50 can be provided and attached to the inner frame support 26, as by bolt 33 in threaded opening 27. The inner frame can have connecting apertures 55. The inner frame 50 can be substantially Z-shaped and include a gap flange portion 54, a coupling portion 56, and an abutment portion 58.

Figure 2B:
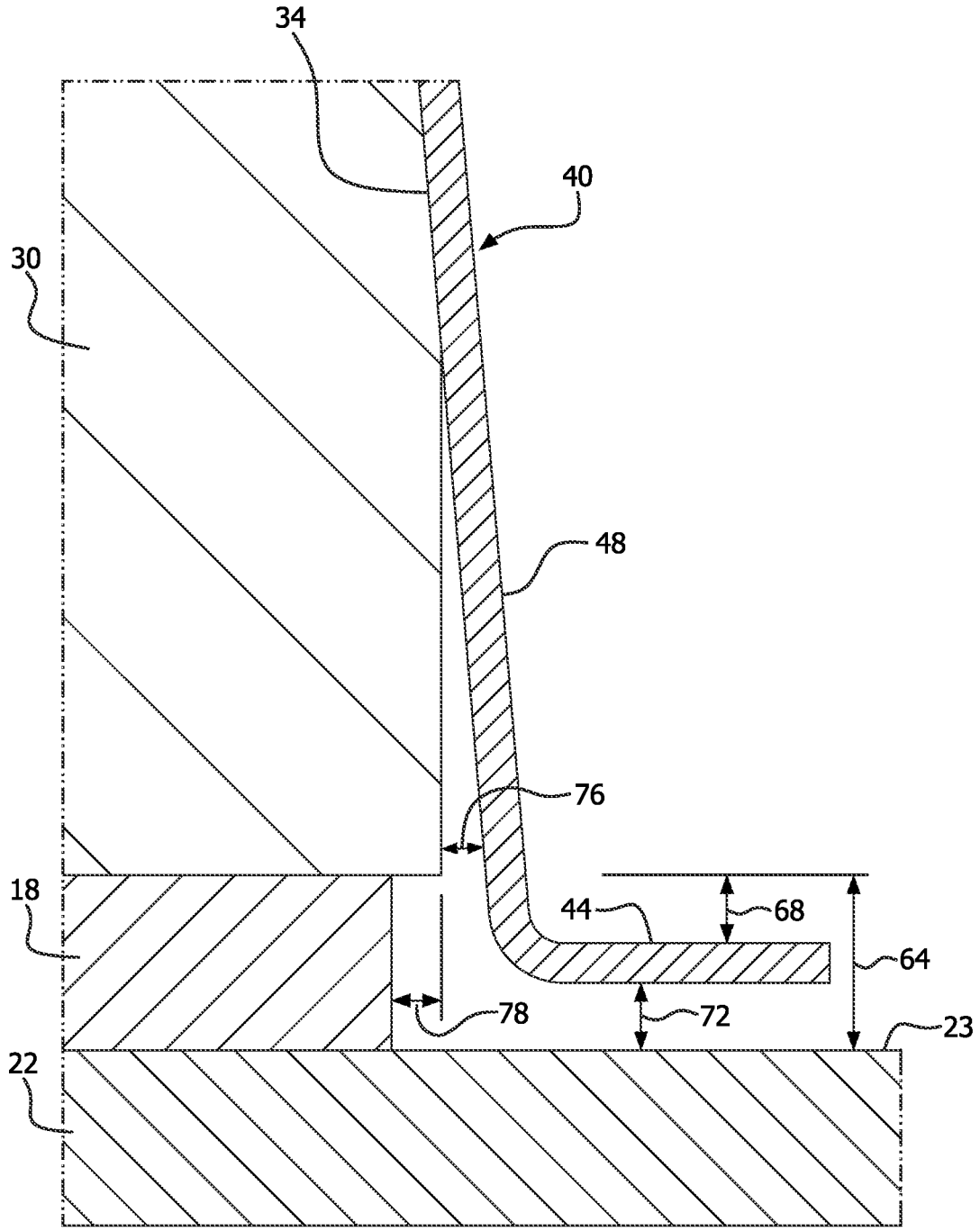
FIG. 2B is an expanded view of area 2B in FIG. 2.
Figure 3:
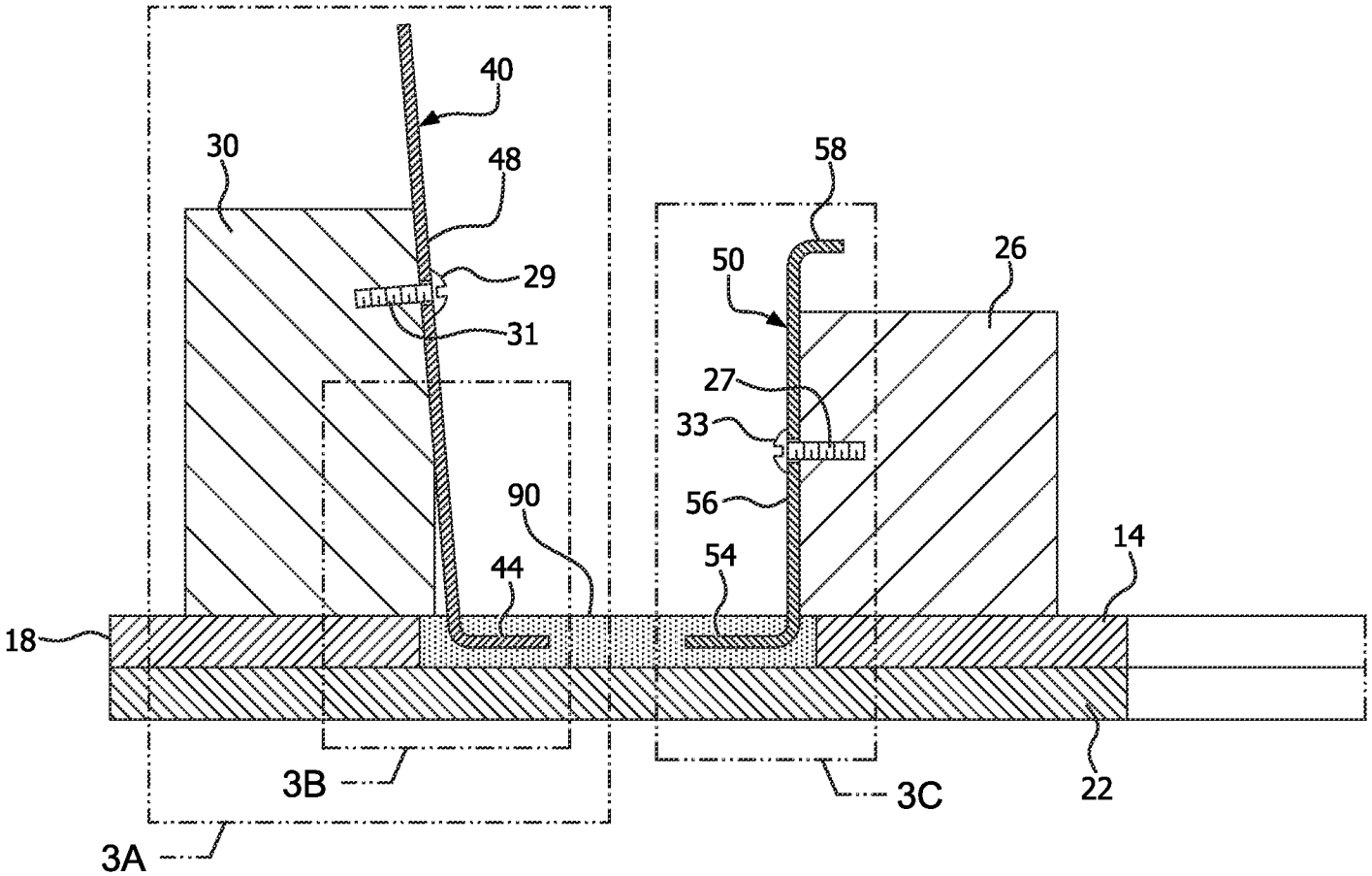
FIG. 3 is the cross section of FIG. 2, and with an elastic material in the mold assembly.
Figure 3A:
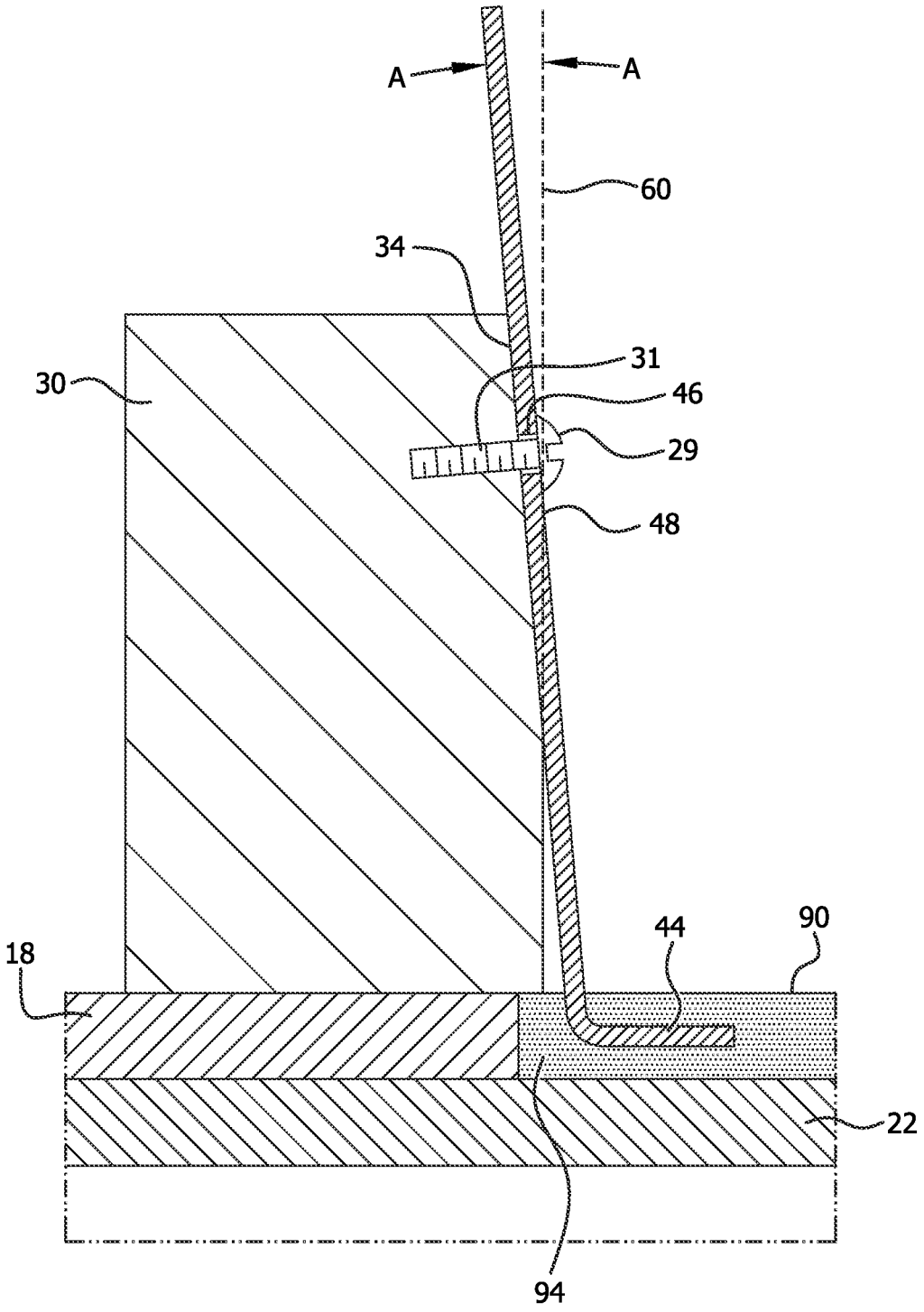
FIG. 3A is an expanded view of area 3A in FIG. 3.
Figure 3B:
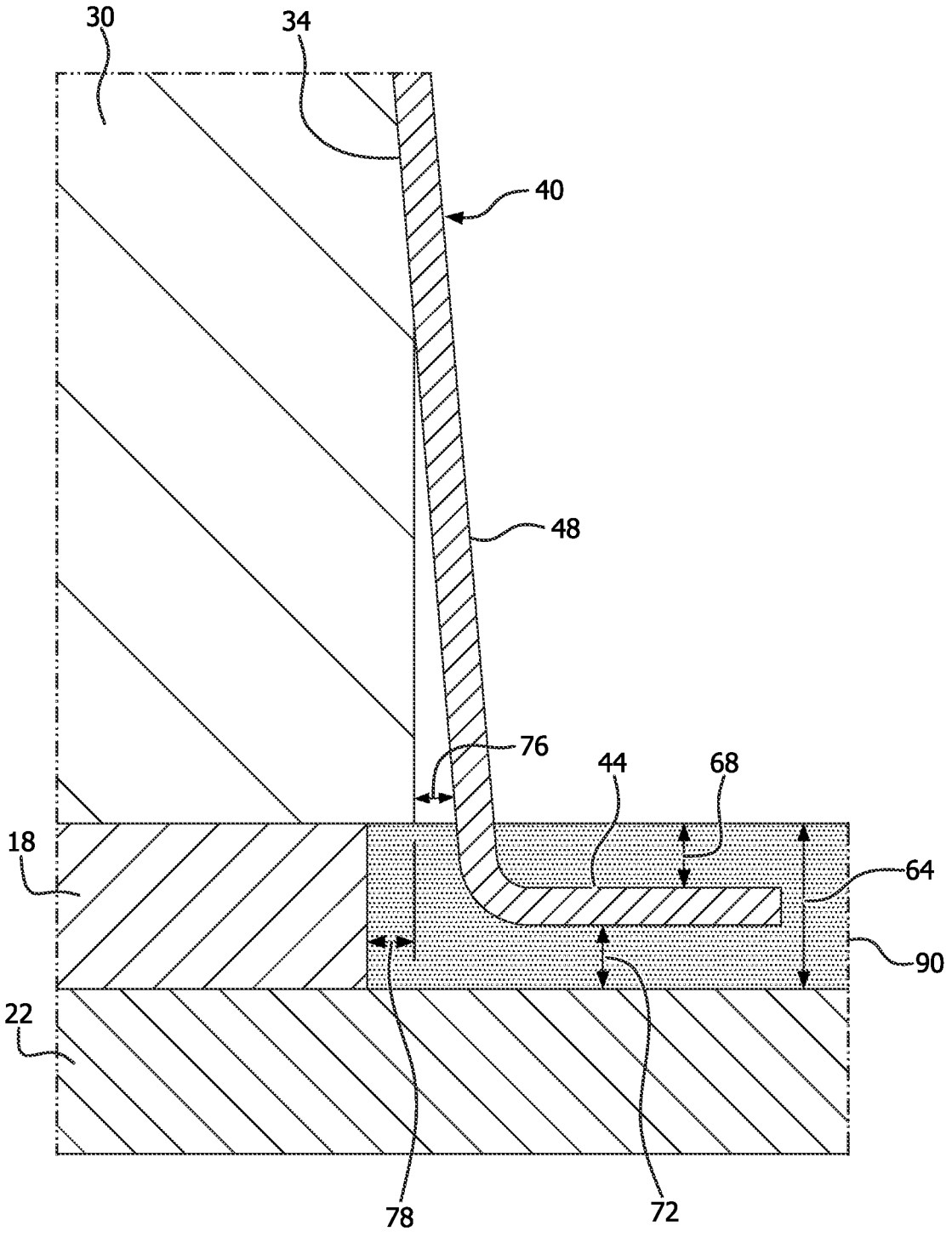
FIG. 3B is an expanded view of area 3B in FIG. 3.

The outer frame 40 is positioned in the mold assembly 10 such that the gap flange portion 44 is suspended a distance 72 from the upper surface 23 of the bottom 22 (FIG. 2B and FIG. 3B). The depth of elastic material 90 to be added is indicated by distance 64. The gap flange 44 is suspended over the upper surface 23 of the bottom 22 such that a thickness 68 of elastic material 90 will be above the gap flange 44, and the thickness 72 of elastic material will be below the gap flange 44. The tilt caused by inclined surface 34 of outer frame supports 30 creates a separation 76 between the coupling portion 48 at the base of the outer frame supports 30.

The mold assembly 10 can be constructed such that the outer frame support 30 overhangs the outer circumferential side 18 by a distance 78. When filled with the elastic material, this distance will represent an added portion of elastic material extending away from the outer frame 40. This additional portion 94 at the lateral side of the elastic material 90 will help to seal the gasket assembly when the outer frame 40 is connected to the window panel or other object.

Figure 2C:
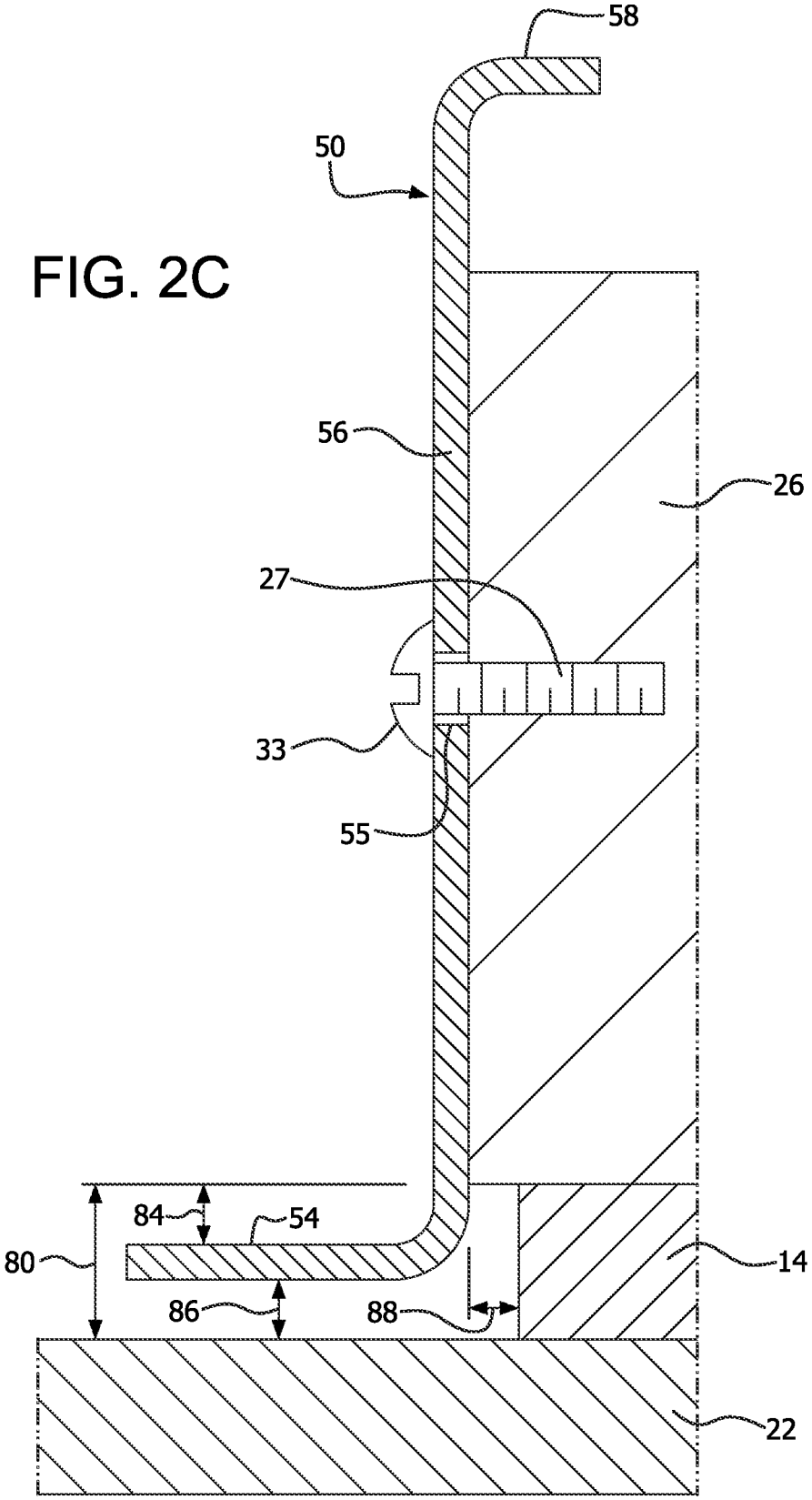
FIG. 2C is an expanded view of area 2C in FIG. 2.
Figure 3C:
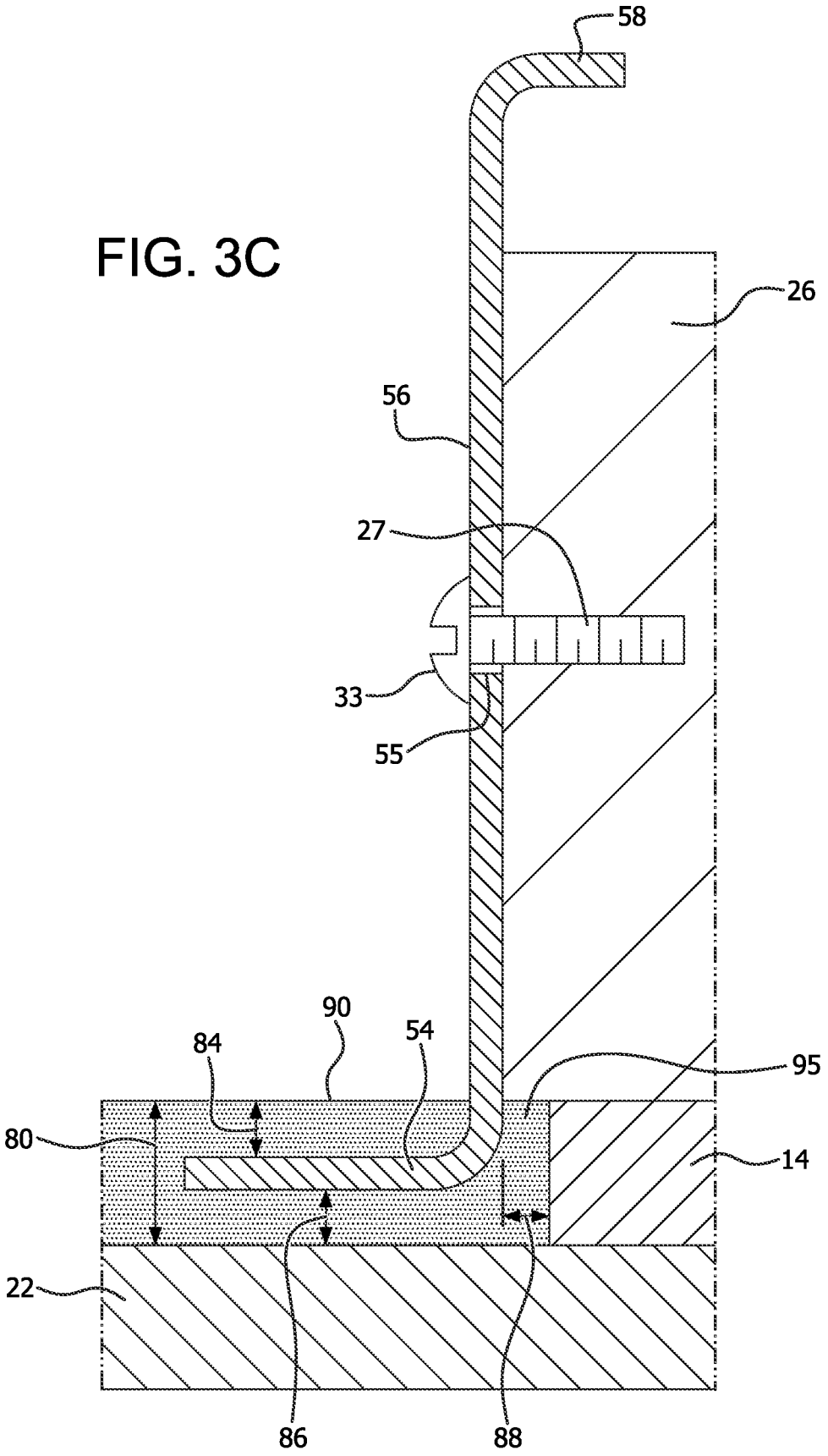
FIG. 3C is an expanded view of area 3C in FIG. 3.

As shown in FIG. 2C and FIG. 3C, the inner frame 50 abuts the outer frame support 26. A thickness 80 of elastic material will be applied, such that a thickness 84 of elastic material will be above the gap flange 54, and a thickness 86 will be below the gap flange 54. The mold assembly 10 can be constructed such that the inner frame support 26 over hangs the inner circumferential side 14 by a distance 88. When filled with the elastic material 90, this distance will represent an added portion of elastic material extending laterally away from the inner frame 50. This additional portion 95 will help to seal the gasket assembly when the inner frame 50 is connected to the window panel.

Figure 4:
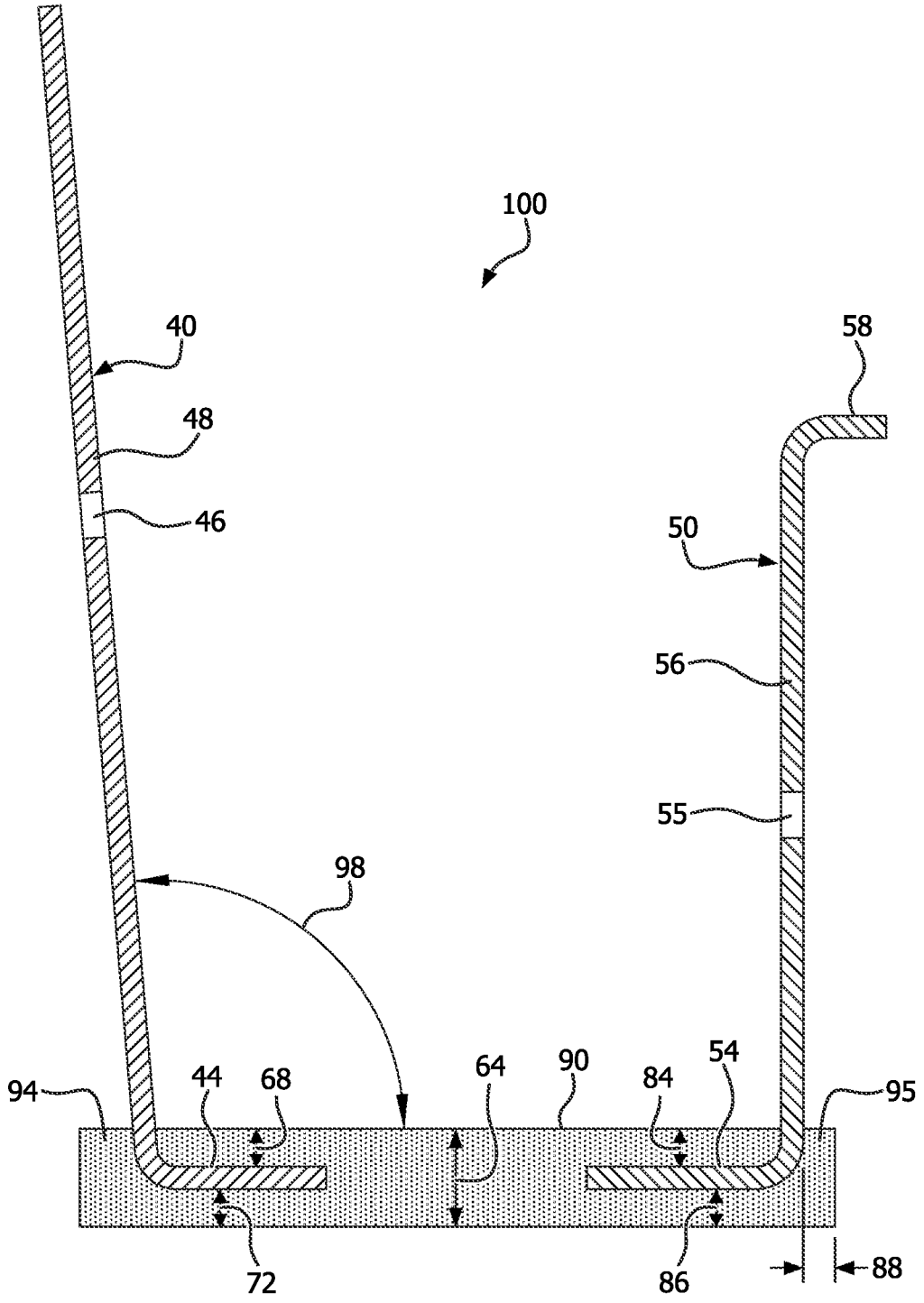
FIG. 4 is a cross section of a gasket assembly according to the invention.
Figure 5:
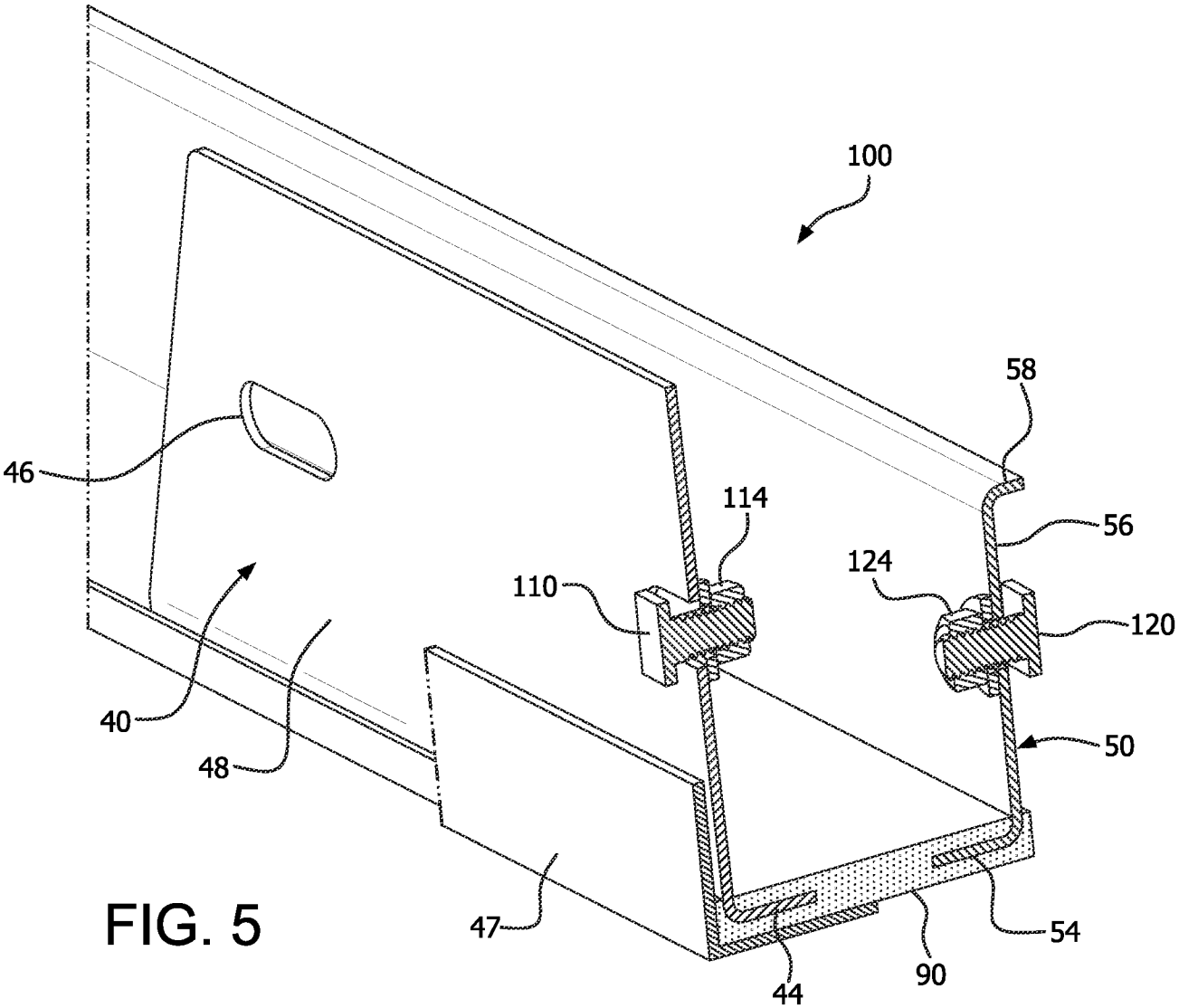
FIG. 5 is a perspective view, partially in cross section, of a portion of the gasket assembly.
Figure 6:
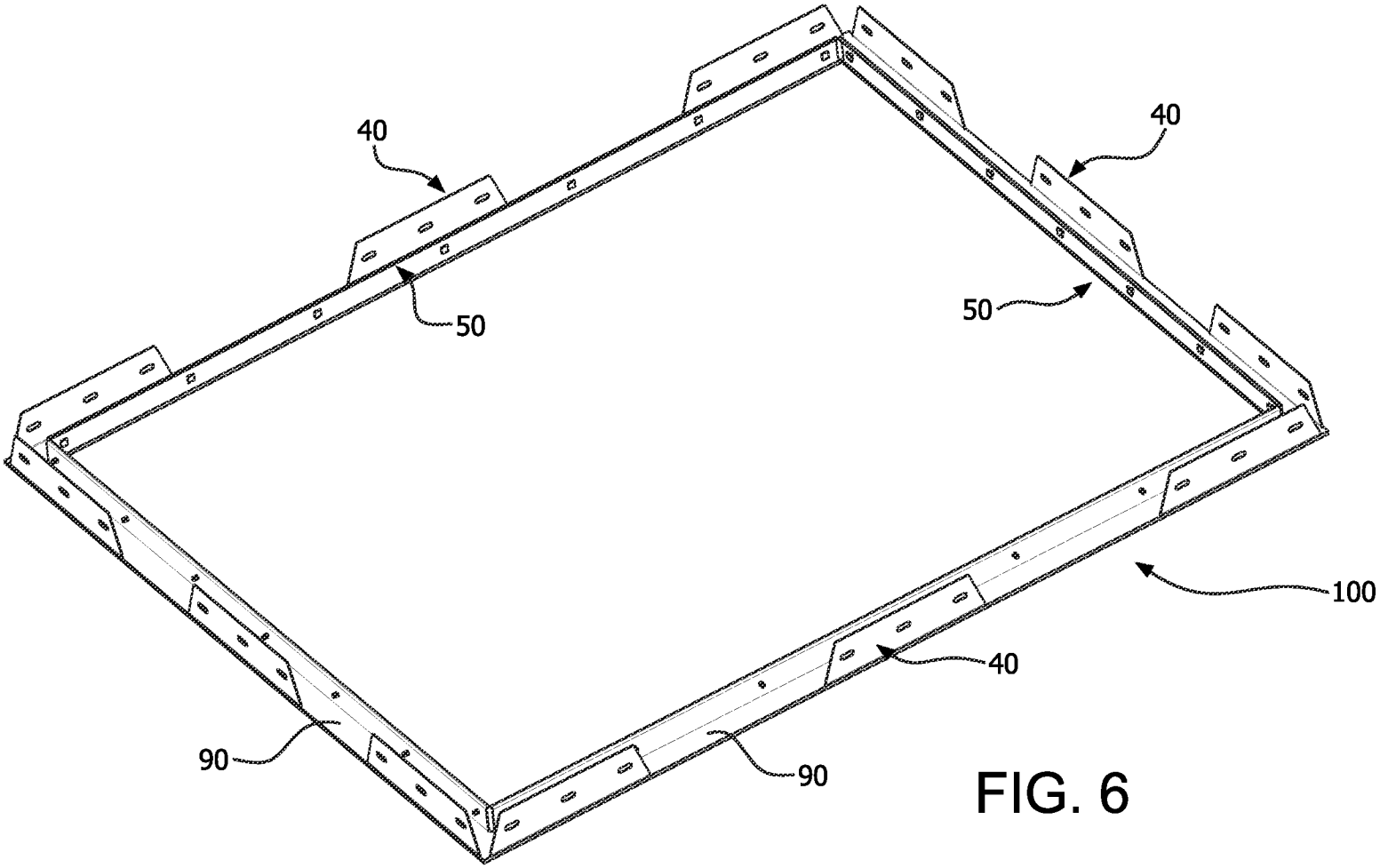
FIG. 6 is a perspective view of the gasket assembly.

The completed gasket assembly 100 is shown in FIGS. 4-6. The gasket assembly includes inner frame 50, outer frame 40, separated and connected by the elastic material 90, The gap between the inner frame 50 and outer frame 40 is filled by the connecting elastic material 90, which provides secure and watertight connection, but also flexibility and elasticity. Suitable structure is provided for connecting the gasket assembly 100 to a window and a window panel. The coupling portion 48 can be angled somewhat more than 90, for example 90.5-95° relative to the elastic portion 90 as indicated by the angle 98. As the coupling portion 48 is secured to the wall panel it will rotate back toward the vertical, squeezing the lateral portion 94 against the adjacent window panel portion to form a tight seal. A connecting bolt 110 can be secured to the coupling portion 48 of the outer frame 40 and connected to a nut 114 (FIG. 4). A connecting bolt 120 can be secured to the coupling portion 56 of the inner frame 50 and secured to a net 124. A bracket 47 may be present in the opening of the wall panel at the discretion of the panel manufacturer. If so, the elastic portion 90 is pressed against a bracket 47 by tightening nut 114 onto stud 110 to form a seal between 90 and 47. Otherwise the elastic portion 90 is pressed against construction structural member 182 that is sealed to the exterior of the window opening, forming a seal.

Figure 7A:
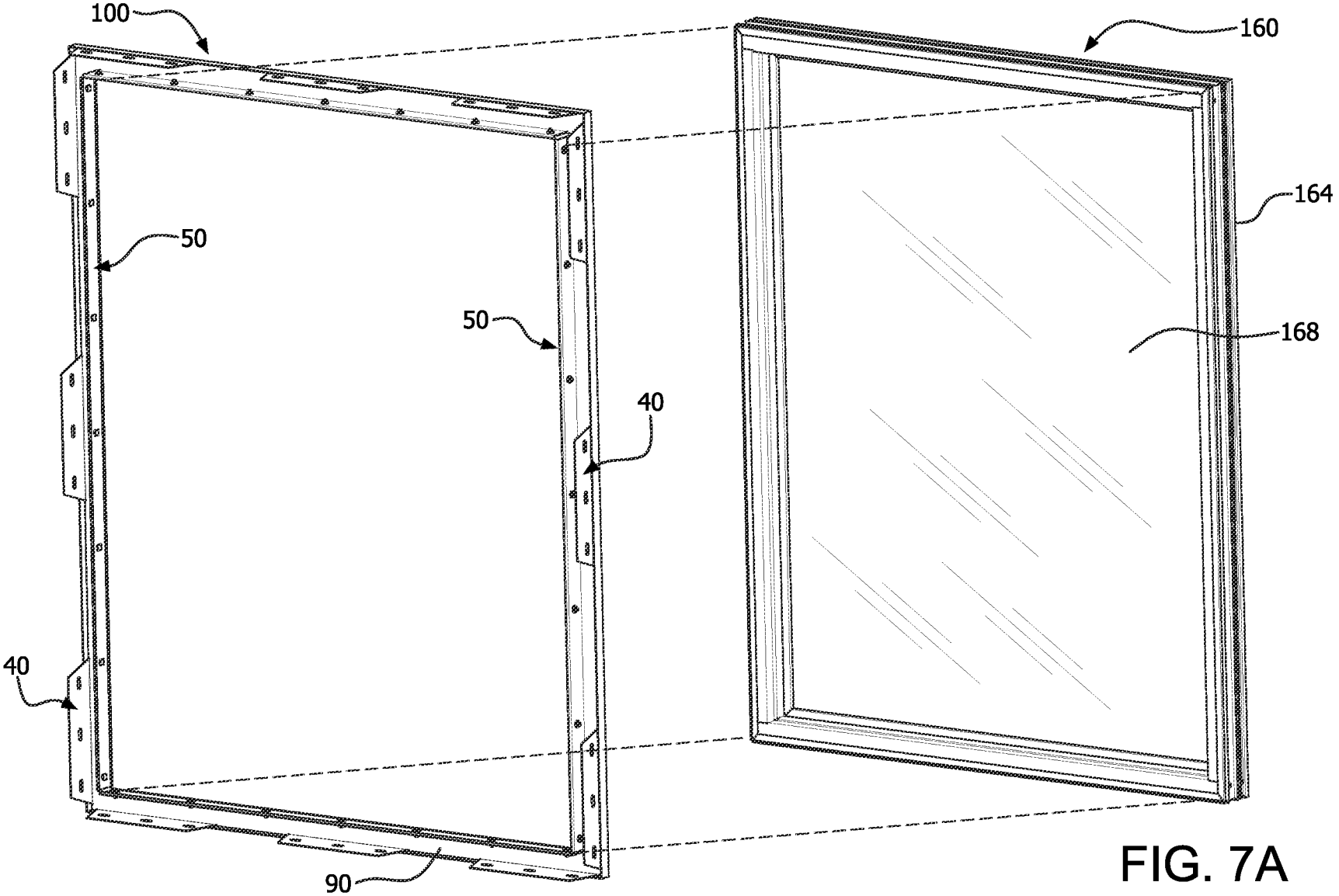
FIG. 7A is an exploded perspective view of a window installed in a gasket assembly.
Figure 7B:
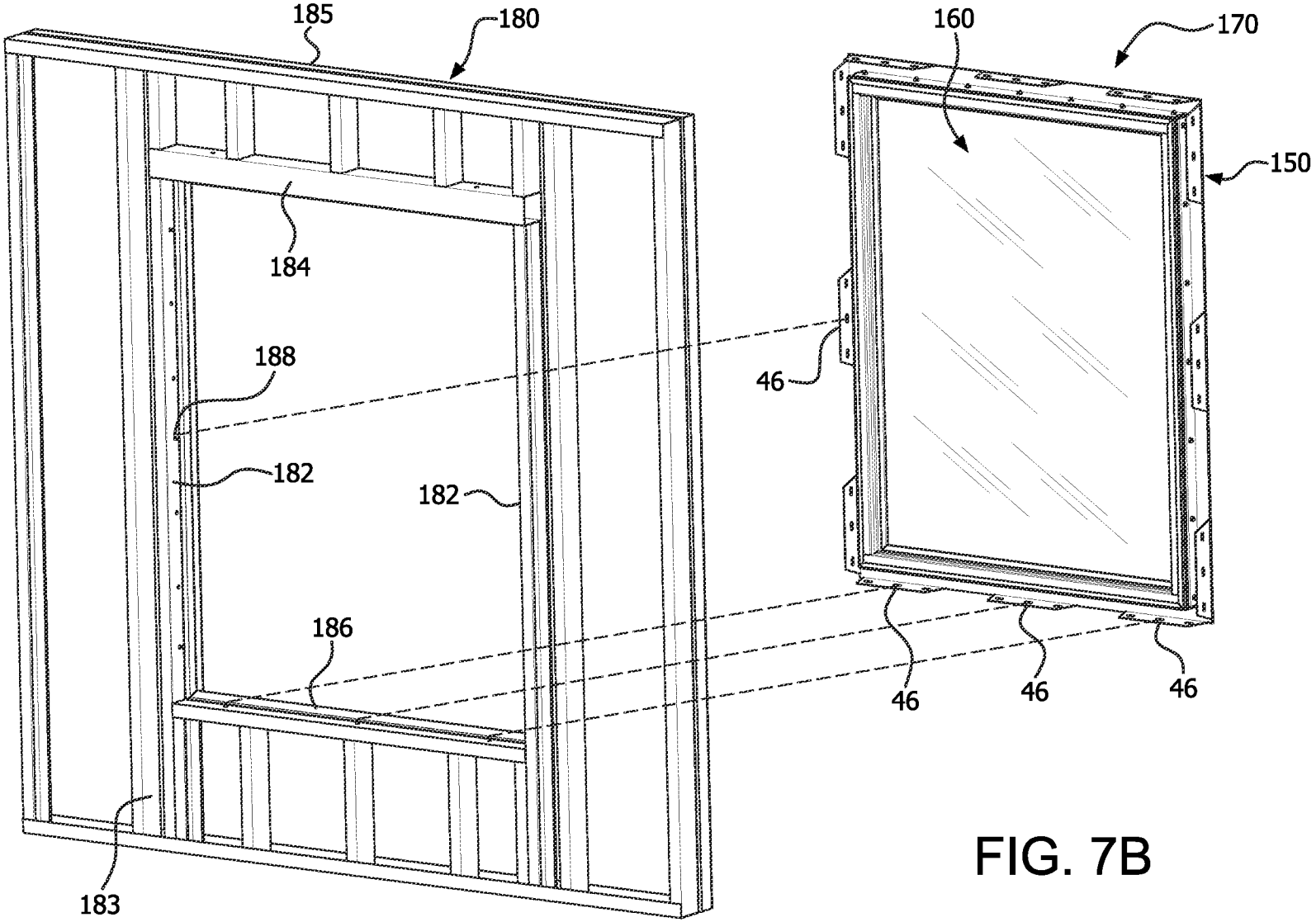
FIG. 7B is an exploded perspective view of a window and gasket assembly installed in a wall panel opening.
Figure 7C:
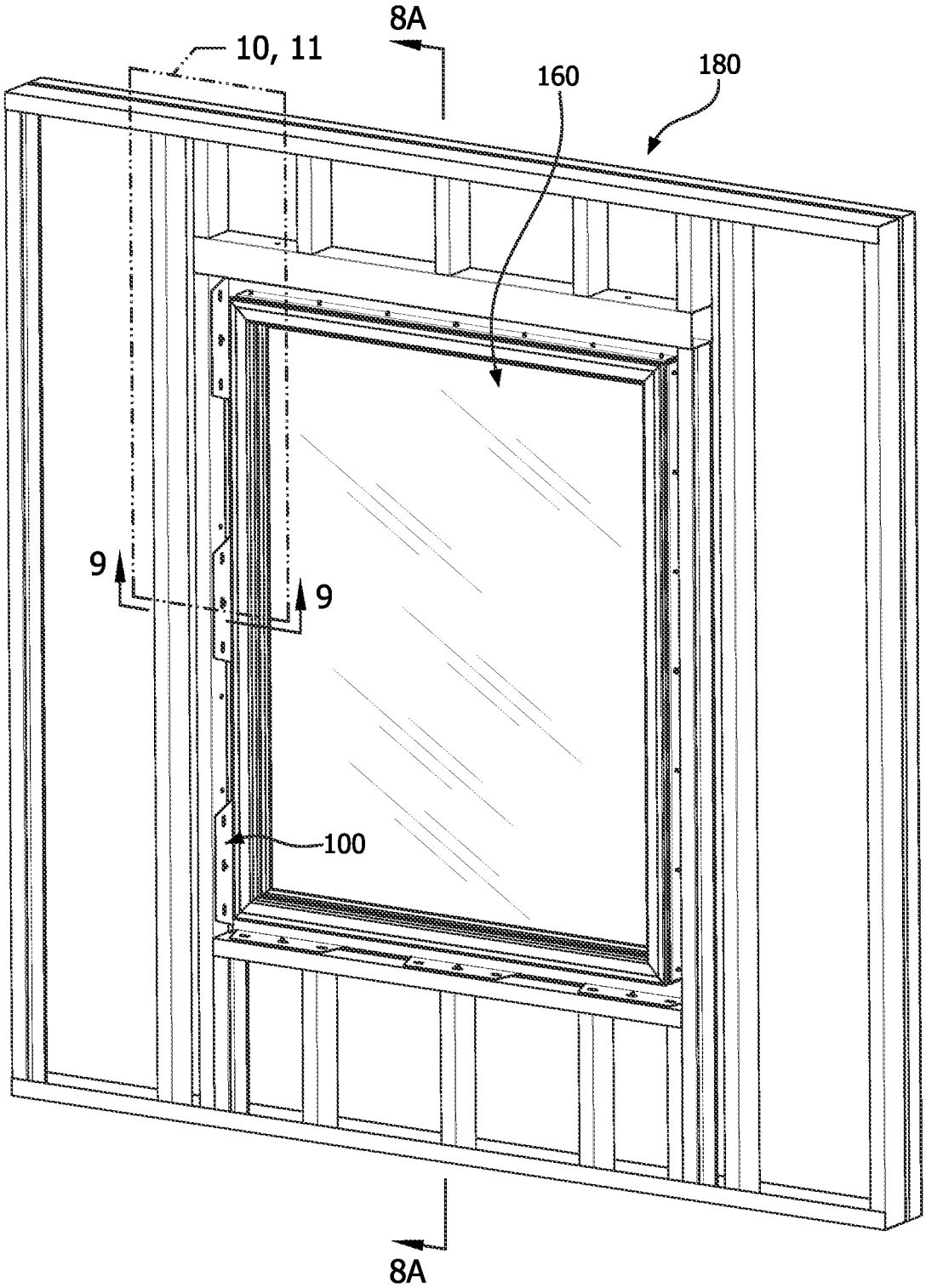
FIG. 7C is a perspective view of a completed installation.

A window 160 can then be secured to the gasket assembly 100, as shown in FIG. 7A, The window 160 includes a window frame 164 and a window pane 168. The window frame 164 in windowpane 168 can be of any suitable construction, including but not limited to the insulating double pane construction that is shown. The resulting window and gasket assembly 170 can then be installed in a window panel as shown in FIGS. 7B-7C. The window panel can be part of a wall assembly 180 and can have side members 182, top member 184 and bottom member 186. Connecting apertures or other fastening structure can be provided to connect to the outer frame 40, as at the apertures 46. The window panel 180 can also be comprised of suitable vertical construction members such as studs 183 and horizontal members such as cross beams 185. Outside panels 190 or siding can be provided. Various other designs are possible. Typical construction materials such as wood and metal for the wall assembly are possible.

Figure 8A:
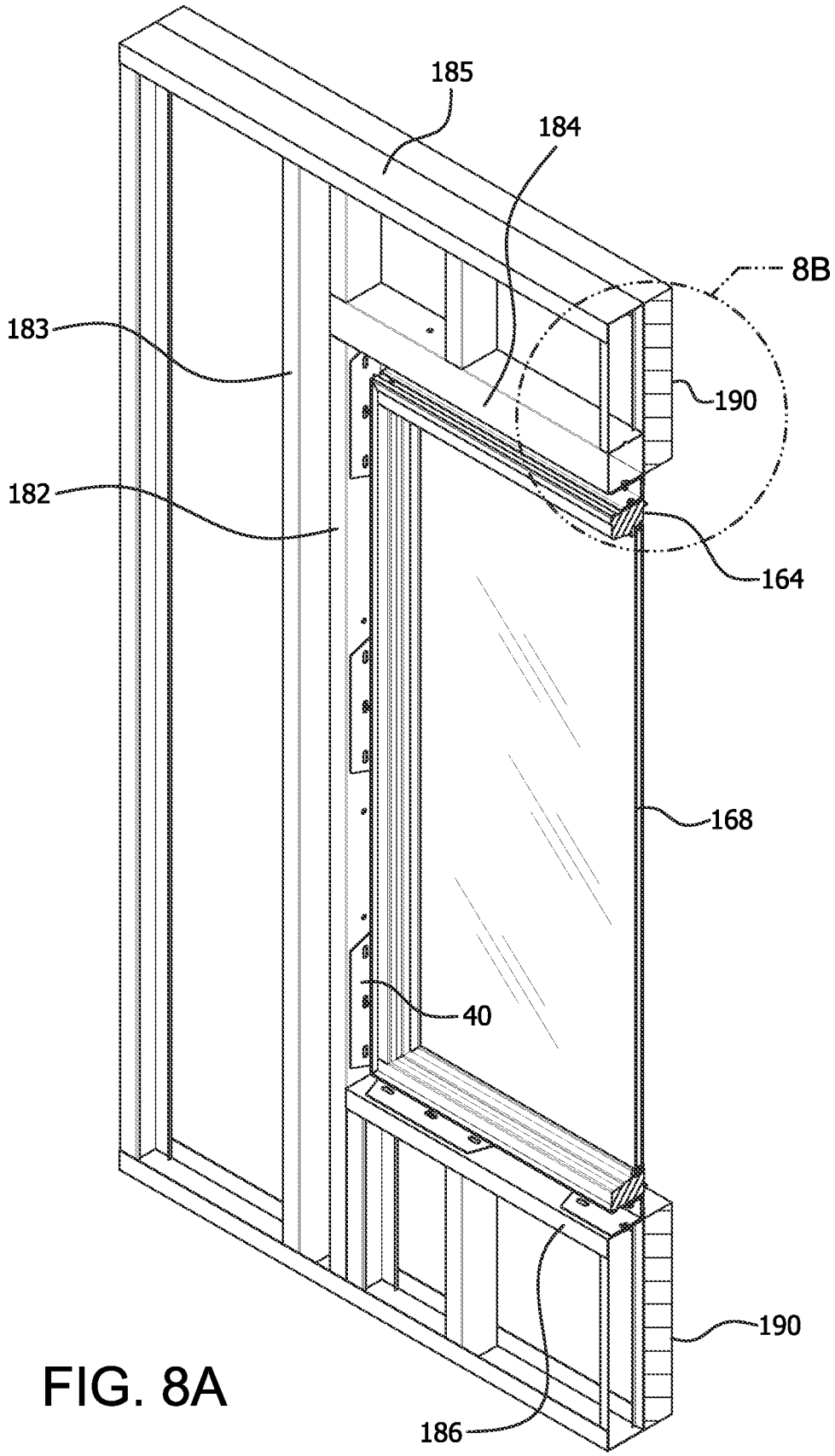
FIG. 8A is a cross section taken along line 8A-8A in FIG. 70.
Figure 8B:
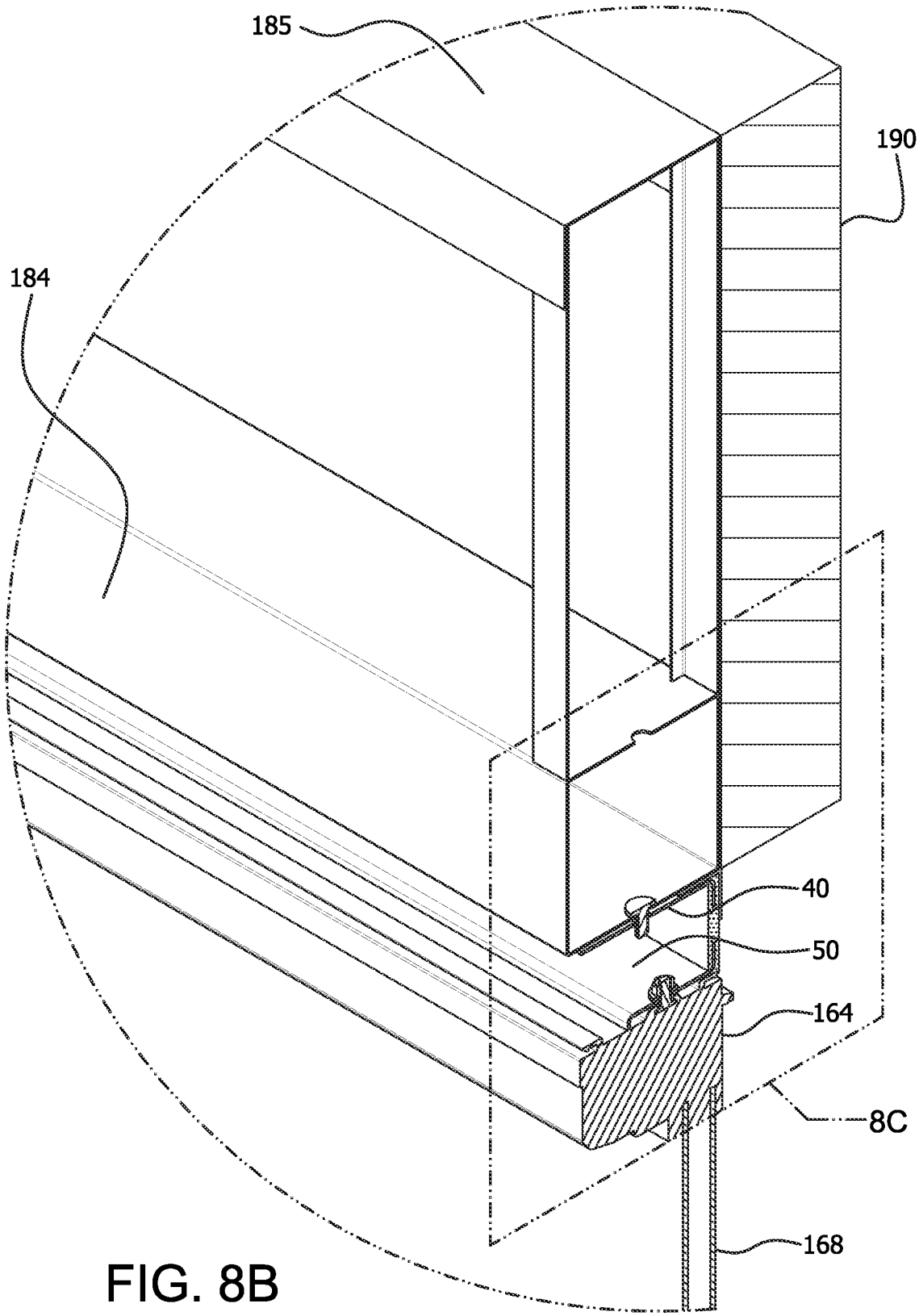
FIG. 8B is an enlarged view of area 8B in FIG. 8A.
Figure 8C:
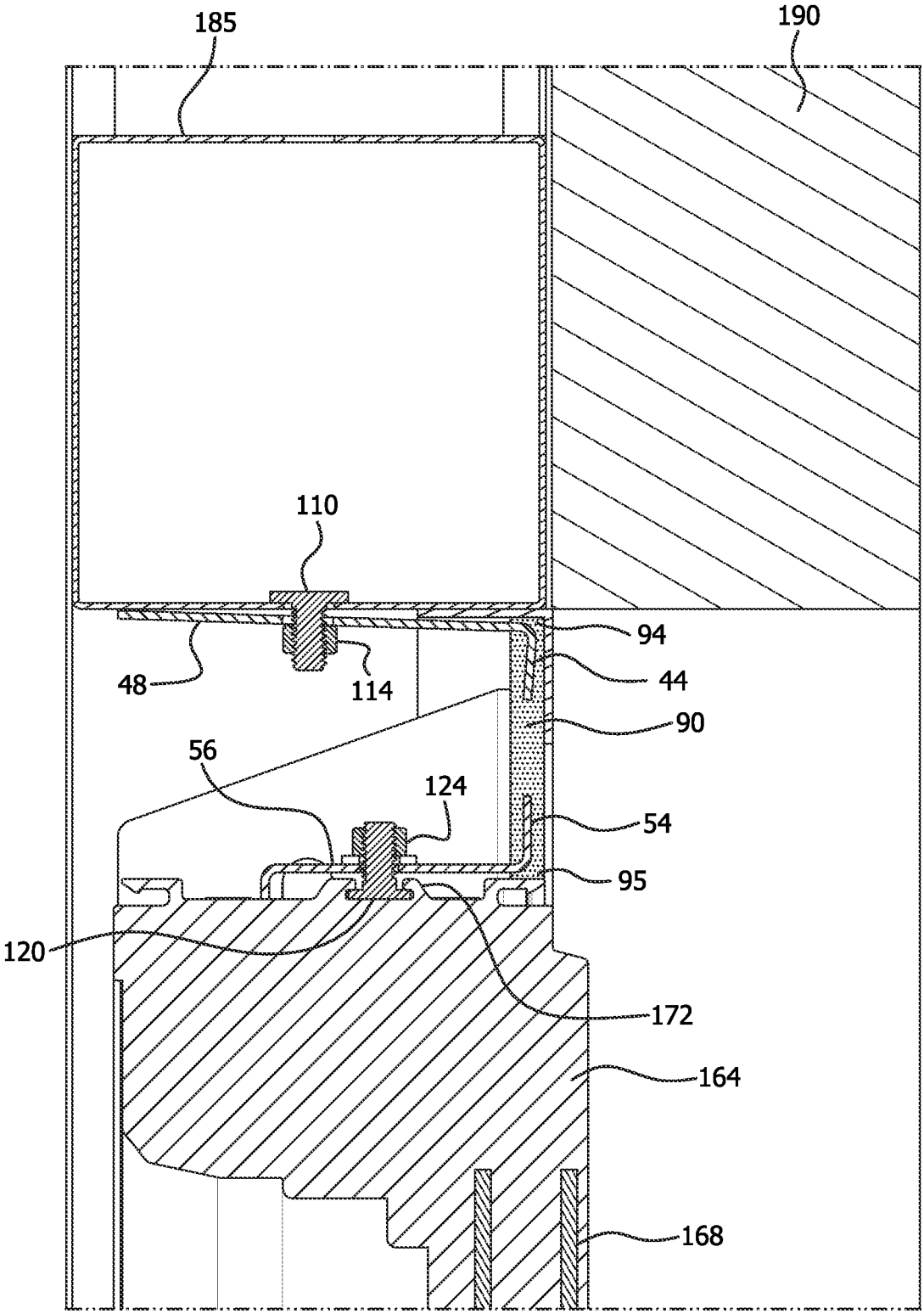
FIG. 8C is an enlarged view of area 80 in FIG. 8B.
Figure 9:
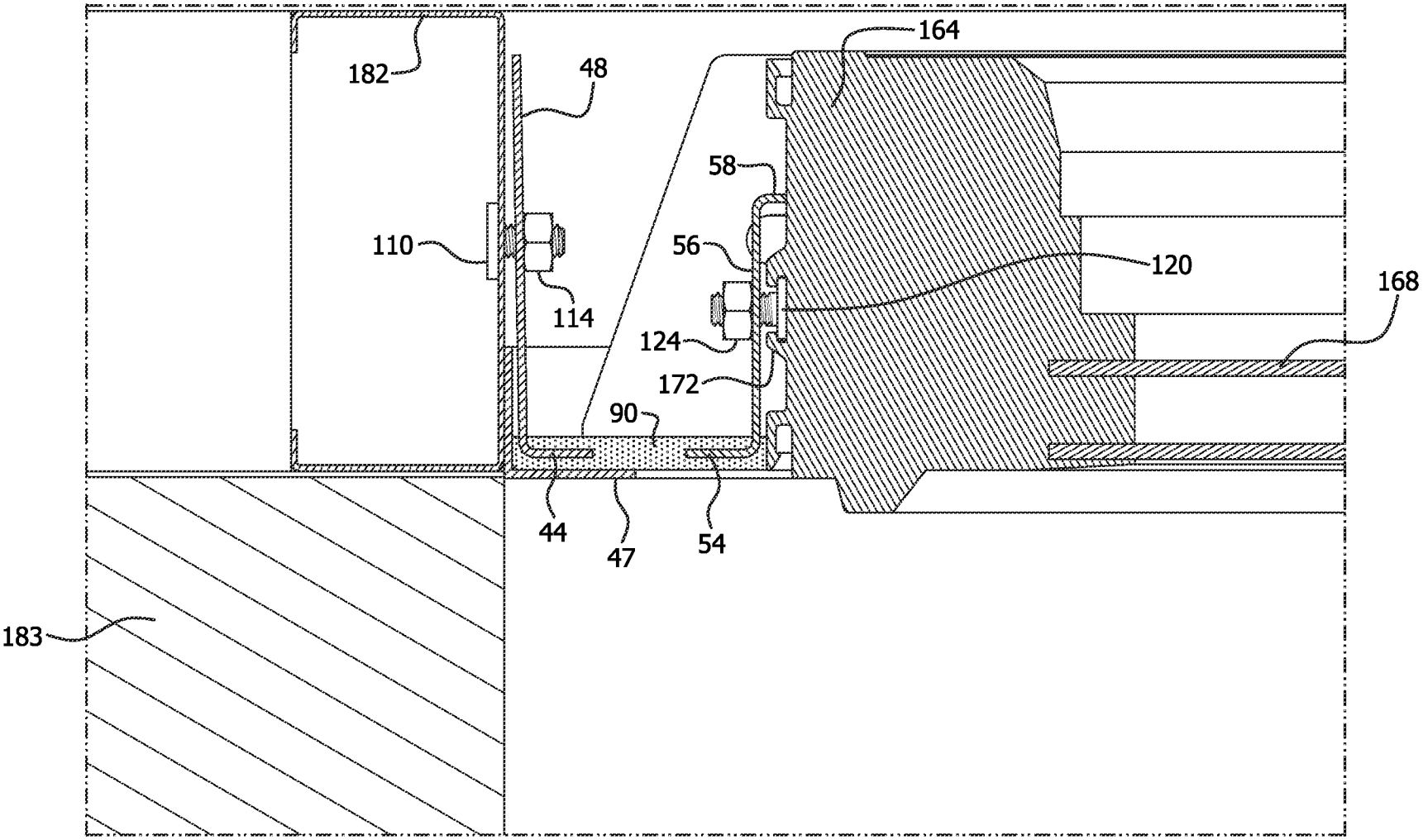
FIG. 9 is a cross section taken along line 9-9 in FIG. 7C.
Figure 10:
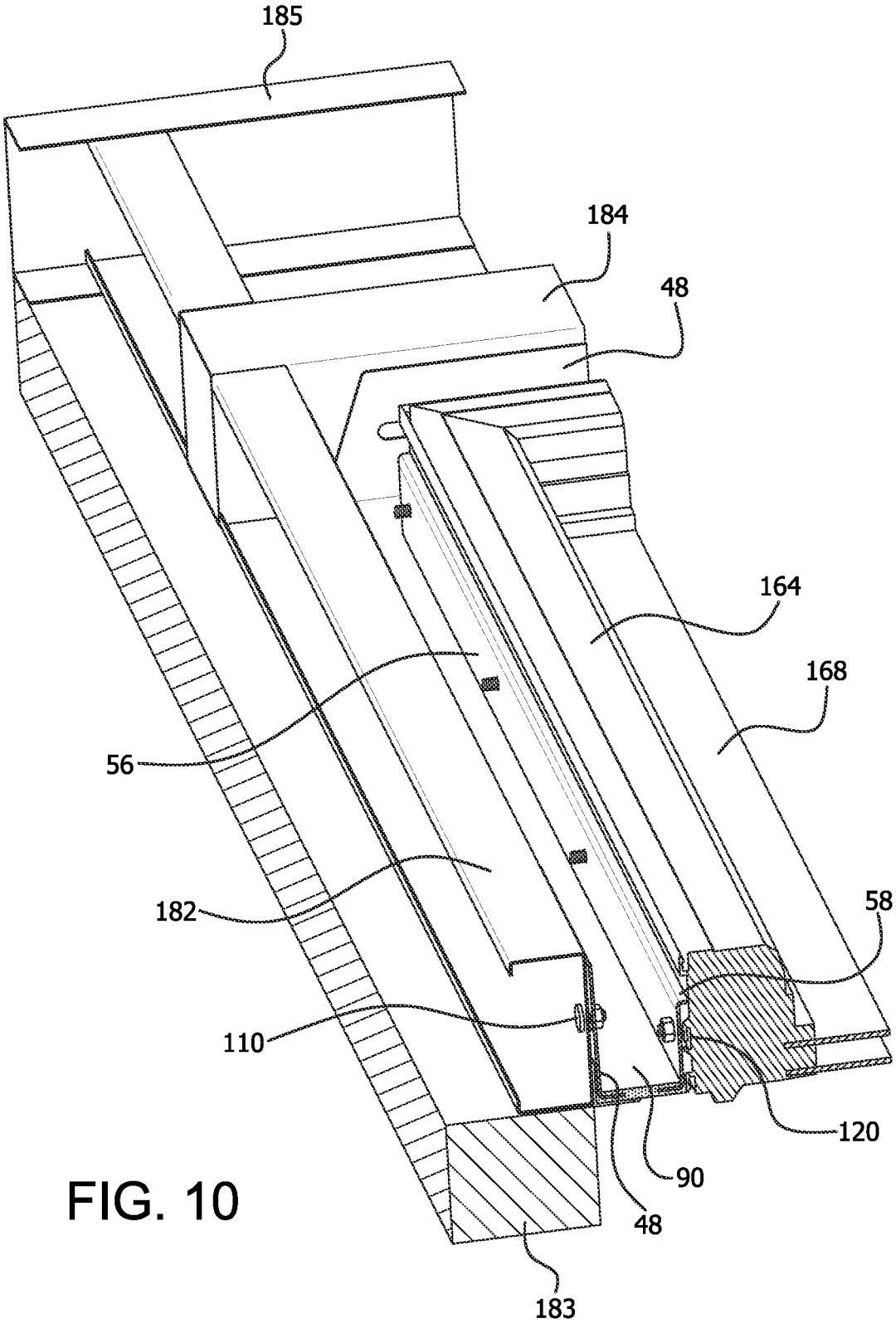
FIG. 10 is a left perspective view, partially in cross section, of area 10 in FIG. 7C.
Figure 11:
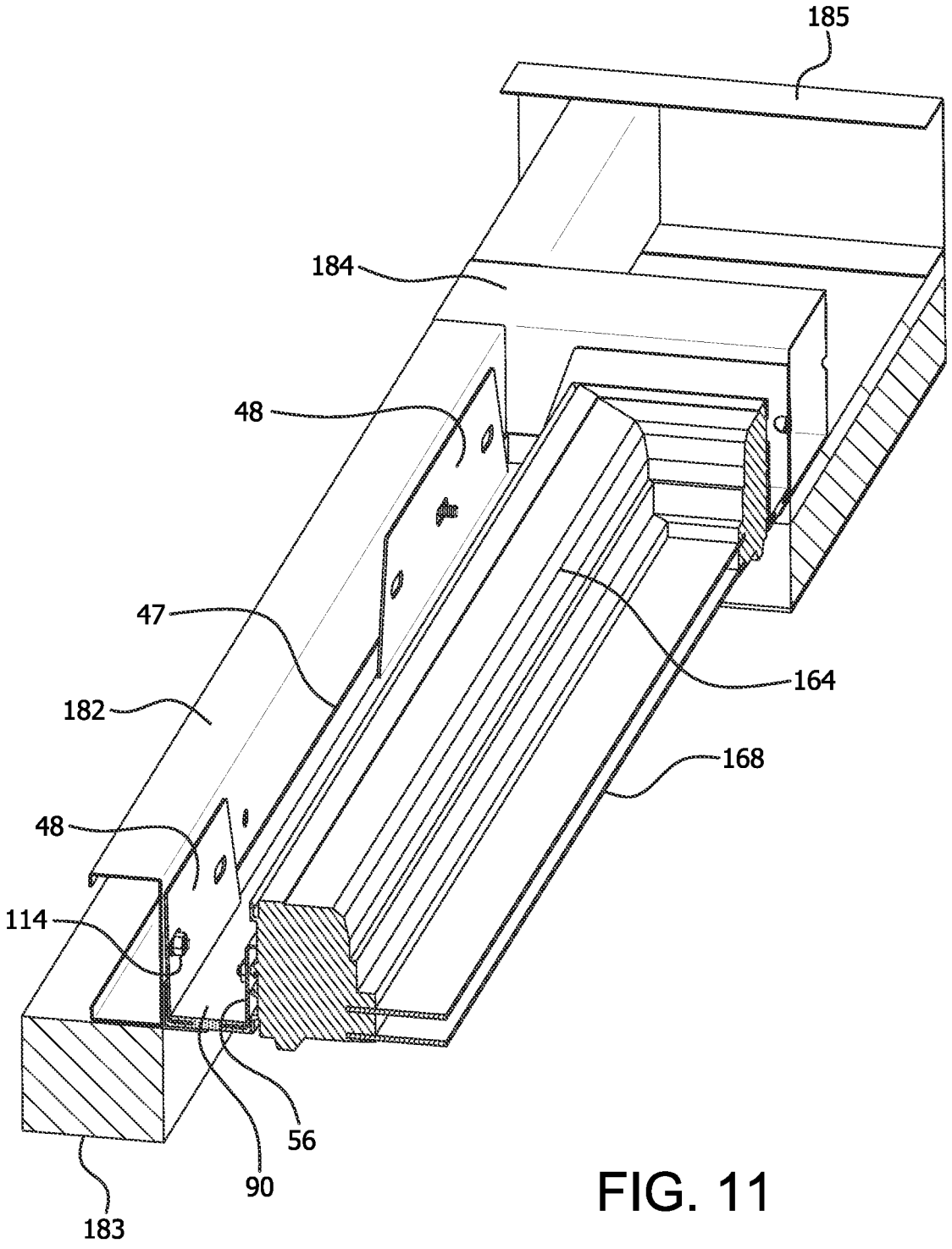
FIG. 11 is a right perspective view, partially in cross section, area 11 in FIG. 7C.
Figure 12:
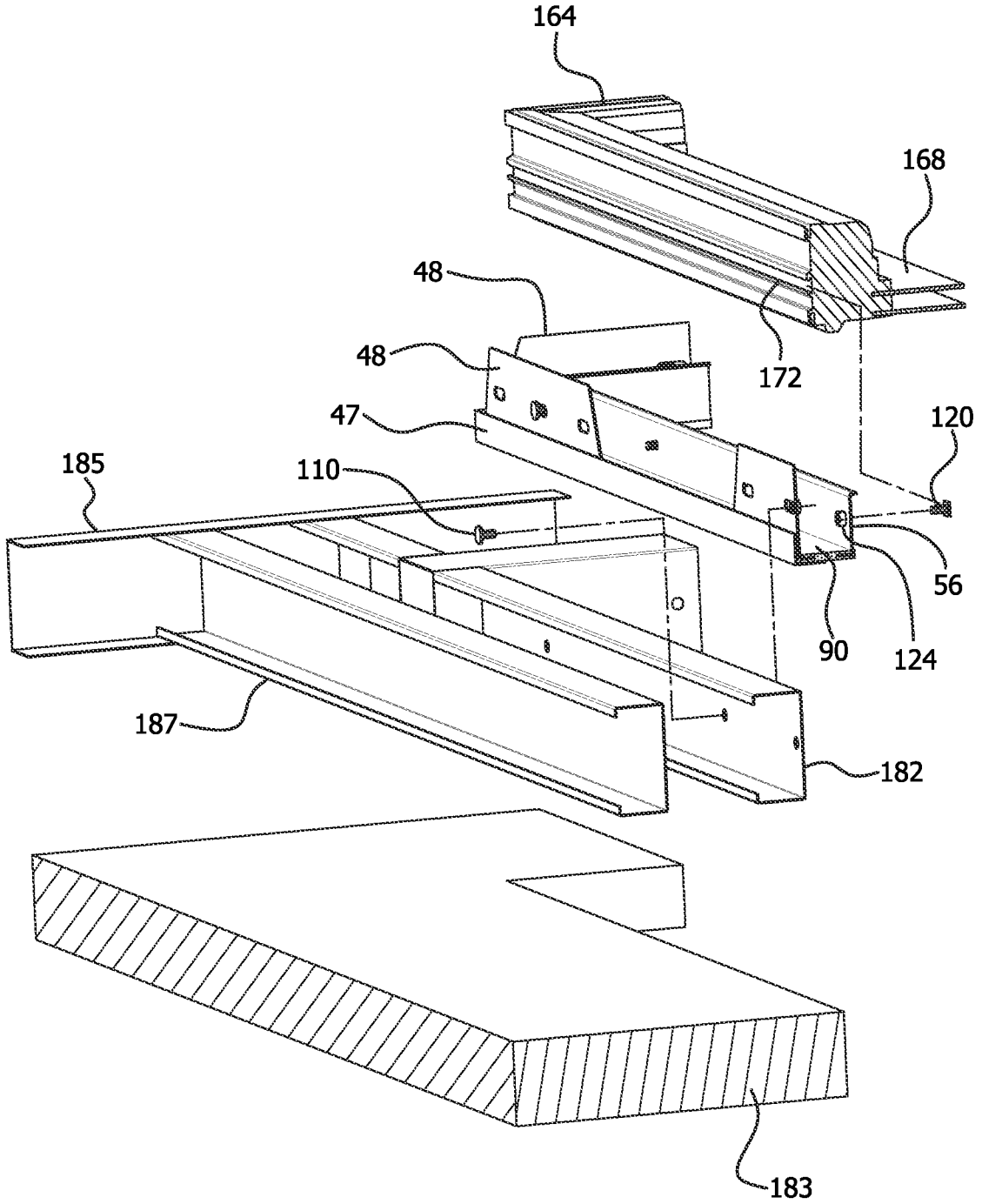
FIG. 12 is an exploded perspective view of a portion of area 10 in FIG. 70.
Figure 13:
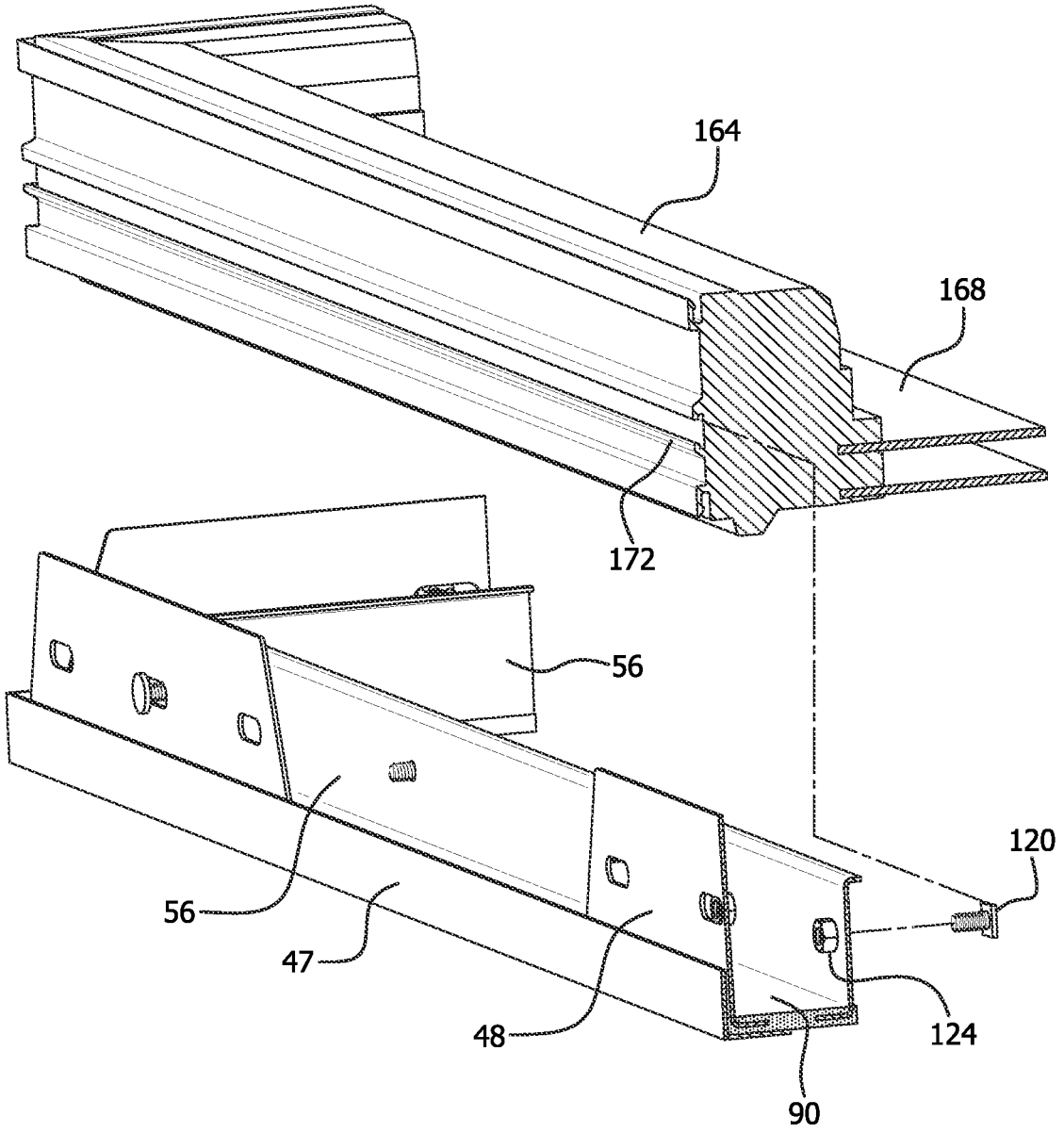
FIG. 13 is an enlarged exploded left side perspective view, partially in cross section, of the window and gasket assembly of FIG. 12.
Figure 14:
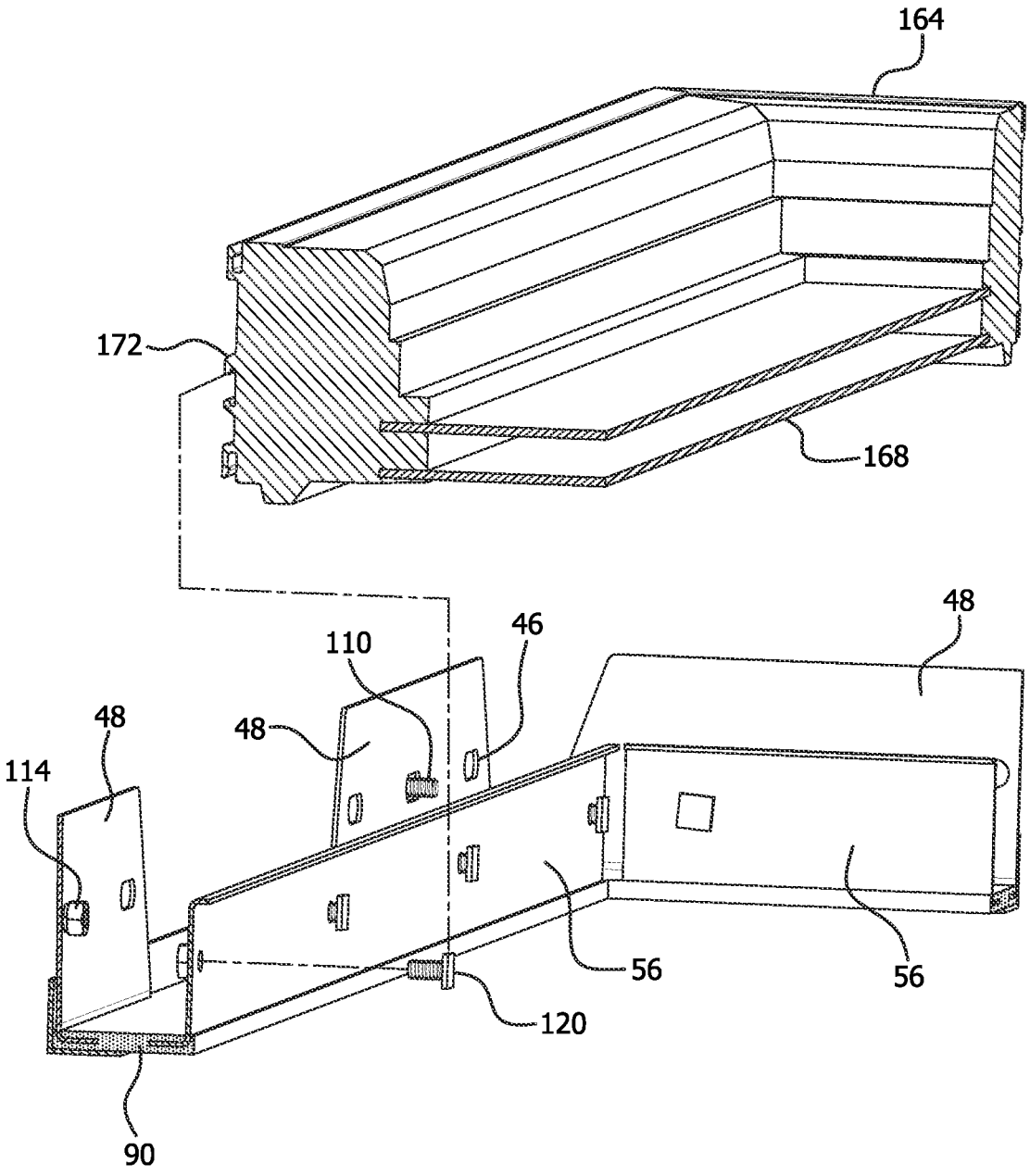
FIG. 14 is an enlarged exploded right-side perspective view, partially in cross section of the window and gasket assembly of FIG. 12.

As shown in FIGS. 8 A-B to FIG. 13, the window frame 164 can include a slotted member 170 for receiving a head of the bolt 120. The nut 124 can be tightened and the coupling portion 58 will be drawn to the window frame 164. Also, the portion 95 of elastic material 90 extending beyond the inner frame 50 will be compressed to form a watertight seal. The outer frame 40 is connected as to construction structural member 182 by tightening the nut 114. The portion 94 of elastic material 90 extending beyond the outer frame 40 will be compressed to form a watertight seal. Also, because the coupling portion 48 is angled relative to the elastic material 90, as the nut 114 is tightened the coupling portion 48 will be pulled tight and this will also act to draw the portion 78 tightly against the construction member 182.

The invention as shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed in accordance with the spirit of the invention, and such changes, alternations and modifications as would occur to those skilled in the art are considered to be within the scope of this invention as broadly defined in the appended claims. In addition, it is to be understood that the phraseology and terminology employed herein are for the purpose of description and should not be regarded as limiting.

We claim:

1. A gasket assembly for attaching a window having a perimeter to a panel opening having a perimeter, comprising:

an inner frame comprising a first rigid material, wherein the inner frame is shaped to match the perimeter of the window;

an outer frame comprising a second rigid material, wherein the outer frame is spaced apart by a gap from the inner frame, the outer frame being shaped to match the perimeter of the panel opening;

an elastic material that is joined to a portion of the outer frame and to a portion of the inner frame, and extends contiguously and circumferentially over the gap to couple the outer frame to the inner frame, wherein the outer frame and the inner frame are connected only by the elastic material;

wherein the outer frame and the inner frame comprise gap flanges and the elastic material comprises opposing lateral side portions, and wherein the gap flanges are embedded in the lateral side portions of the elastic material;

the outer frame comprising a connecting structure for coupling of the outer frame to the panel opening, and the inner frame comprising a connecting structure for coupling of the gasket assembly to the window;

whereby the gasket assembly is configured to support the window in the panel opening and form a seal between the panel opening and the window.

2. The gasket assembly of claim 1, wherein the elastic material is hydrophobic without voids or surface defects on a sealing surface thereof.

3. The gasket assembly of claim 1, wherein the elastic material comprises at least one selected from the group consisting of urethanes (polyurethane, TPU), rubbers, and nylon.

4. The gasket assembly of claim 1, wherein the elastic material has a Durometer Shore Hardness from 20 A to 90 A.

5. The gasket of claim 1, wherein the elastic material has a thickness of from 0.3 cm. to 1.25 cm.

6. The gasket assembly of claim 1, wherein the elastic material extends laterally outward beyond the gap flanges of the outer frame and the inner frame by from 0.1 cm. to 0.6 cm.

7. The gasket assembly of claim 6, wherein the gap flanges and the gap have a width, and the width of each of the gap flanges is from 1.0 cm to 2.0 cm and the width of the gap is 0.5 to 4 cm.

8. The gasket assembly of claim 1, wherein the inner frame is Z-shaped in cross-section.

9. The gasket assembly of claim 8, wherein the inner frame comprises a gap flange portion, a coupling portion, and an abutment portion.

10. The gasket assembly of claim 9, wherein the gap flange portion comprises a laterally inward extending flange embedded in a lateral side portion of the elastic material, and the abutment flange comprises a laterally outward extending flange.

11. The gasket assembly of claim 1, wherein the outer frame is L-shaped in cross section.

12. The gasket assembly of claim 11, wherein the outer frame comprises a gap flange portion and a coupling portion, a surface of the elastic material is planar, and the coupling portion is planar and angled laterally outward.

13. The gasket assembly of claim 12, wherein the coupling portion is angled laterally outward with respect to the surface of the elastic material at an angle between 0.5 and 5 degrees from of a normal to the plane of the elastic material.

14. The gasket assembly of claim 1, wherein the connecting structure of the inner frame comprises a T-fitting for engaging a window frame of the window.

15. The gasket assembly of claim 1, wherein the window has a weight, the gasket assembly has a width, and wherein the elastic material has a thickness and an elastic modulus, and wherein the elastic modulus and thickness of the elastic material support the weight of the window such that the gasket assembly width varies by no more than 10% elongation of the width of the elastic material when installed.

* * * * *